US010894400B2

(12) United States Patent
Murayama et al.

(10) Patent No.: US 10,894,400 B2
(45) Date of Patent: Jan. 19, 2021

(54) LIQUID EJECTING APPARATUS

(71) Applicant: SEIKO EPSON CORPORATION, Tokyo (JP)

(72) Inventors: Toshiro Murayama, Fujimi (JP); Shunya Fukuda, Azumino (JP); Noriaki Okazawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 20 days.

(21) Appl. No.: 16/362,350

(22) Filed: Mar. 22, 2019

(65) Prior Publication Data

US 2019/0291411 A1 Sep. 26, 2019

(30) Foreign Application Priority Data

Mar. 23, 2018 (JP) ..... 2018-056661

(51) Int. Cl.
*B41J 2/045* (2006.01)
*B41J 2/165* (2006.01)
(Continued)

(52) U.S. Cl.
CPC ..... *B41J 2/0451* (2013.01); *B41J 2/04553* (2013.01); *B41J 2/04563* (2013.01);
(Continued)

(58) Field of Classification Search
CPC .. B41J 2/0451; B41J 2/04553; B41J 2/04563; B41J 2/04571; B41J 2/04581;
(Continued)

(56) References Cited

U.S. PATENT DOCUMENTS 8,690,279 B2 * 4/2014 Zhang ..... B41J 2/04551 347/10
9,937,710 B2 * 4/2018 Zhang ..... B41J 2/0451
(Continued)

FOREIGN PATENT DOCUMENTS

| | | | |
|---|---|---|---|
| JP | 2017013328 | A | 1/2017 |
| JP | 2017177423 | A | 10/2017 |
| JP | 2017-205744 | A | 11/2017 |

OTHER PUBLICATIONS

European Search Report issued in application No. EP19164661, dated Aug. 15, 2019.

*Primary Examiner* — Thinh H Nguyen
(74) *Attorney, Agent, or Firm* — Workman Nydegger

(57) ABSTRACT

A liquid ejecting apparatus is provided with pressure generating units for pressure chambers one of which is provided for each of a plurality of nozzles and drives the pressure generating units corresponding to liquid ejection requests which request liquid ejection from the nozzles while achieving supplying of a liquid to the pressure chambers and collection of the liquid which has passed through the pressure chambers. Accordingly, the liquid is ejected from the nozzles. Meanwhile, an occurrence of a fault in the liquid ejection is determined using a vibration transition of a residual vibration which occurs in the liquid of the pressure chambers according to a pressure change accompanying driving of the pressure generating units, and driving of the pressure generating unit of an ejection fault pressure chamber in which it is determined that a fault occurs in the liquid ejection is stopped spanning at least a fixed stopping period.

15 Claims, 18 Drawing Sheets

(51) Int. Cl.
*B41J 2/21* (2006.01)
*B41J 2/18* (2006.01)
*B41J 2/14* (2006.01)

(52) U.S. Cl.
CPC ..... *B41J 2/04571* (2013.01); *B41J 2/04581* (2013.01); *B41J 2/04596* (2013.01); *B41J 2/14233* (2013.01); *B41J 2/16508* (2013.01); *B41J 2/16517* (2013.01); *B41J 2/16532* (2013.01); *B41J 2/16538* (2013.01); *B41J 2/16579* (2013.01); *B41J 2/18* (2013.01); *B41J 2/2139* (2013.01); *B41J 2/2142* (2013.01); *B41J 2202/12* (2013.01)

(58) Field of Classification Search
CPC ..... B41J 2/04596; B41J 2/14233; B41J 2/16508; B41J 2/16517; B41J 2/16532; B41J 2/16538; B41J 2/16579; B41J 2/18; B41J 2/2139; B41J 2/2142; B41J 2202/12
See application file for complete search history.

(56) References Cited

U.S. PATENT DOCUMENTS

| | | | |
|---|---|---|---|
| 2012/0051823 | A1 | 3/2012 | Hoshino |
| 2012/0182354 | A1 | 7/2012 | Akahane |
| 2013/0307896 | A1 | 11/2013 | Shinkawa |
| 2016/0236463 | A1 | 8/2016 | Kamiyanagi |
| 2017/0057218 | A1 | 3/2017 | Zhang |

* cited by examiner

LIQUID EJECTING APPARATUS

BACKGROUND

1. Technical Field

The present invention relates to a liquid ejecting apparatus.

2. Related Art

A liquid ejecting apparatus which ejects a liquid from a nozzle is used as an ink jet printing apparatus which ejects an ink which is a liquid, for example. In the printing apparatus, since ejection abnormalities occur due to the entrance of bubbles, foreign matter, or the like mixed in the ink, a countermeasure to the entrance of bubbles, foreign matter, or the like is proposed (for example, JP-A-2017-205744). In JP-A-2017-205744, processes such as wiping of a nozzle surface, flushing, and cap suction of the nozzle surface are performed according to the origin of the ejection abnormalities.

However, it is difficult to recover from the ejection abnormalities of the nozzle while printing with the method proposed in JP-A-2017-205744 and there is a problem in that the availability factor of the liquid ejecting apparatus is greatly reduced.

SUMMARY

According to an aspect of the invention, there is provided a liquid ejecting apparatus including a plurality of nozzles which eject a liquid, pressure chambers which communicate with the nozzles, pressure generating units which cause pressures of the pressure chambers to change, a liquid supplying unit which carries out supplying of the liquid to the pressure chambers and collection of the liquid which has passed through the pressure chambers, a controller which drives the pressure generating units of the pressure chambers corresponding to liquid ejection requests which request liquid ejection from the nozzles, and an ejection fault determination unit which determines an occurrence of a fault in the liquid ejection using a vibration transition of a residual vibration which occurs in the liquid of the pressure chambers according to a pressure change which accompanies driving of the pressure generating units, in which the controller stops the driving of the pressure generating unit of an ejection fault pressure chamber in which it is determined that a fault occurs in the liquid ejection by the ejection fault determination unit spanning at least a fixed stopping period.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Embodiment

A-1. Apparatus Configuration

Figure 1:
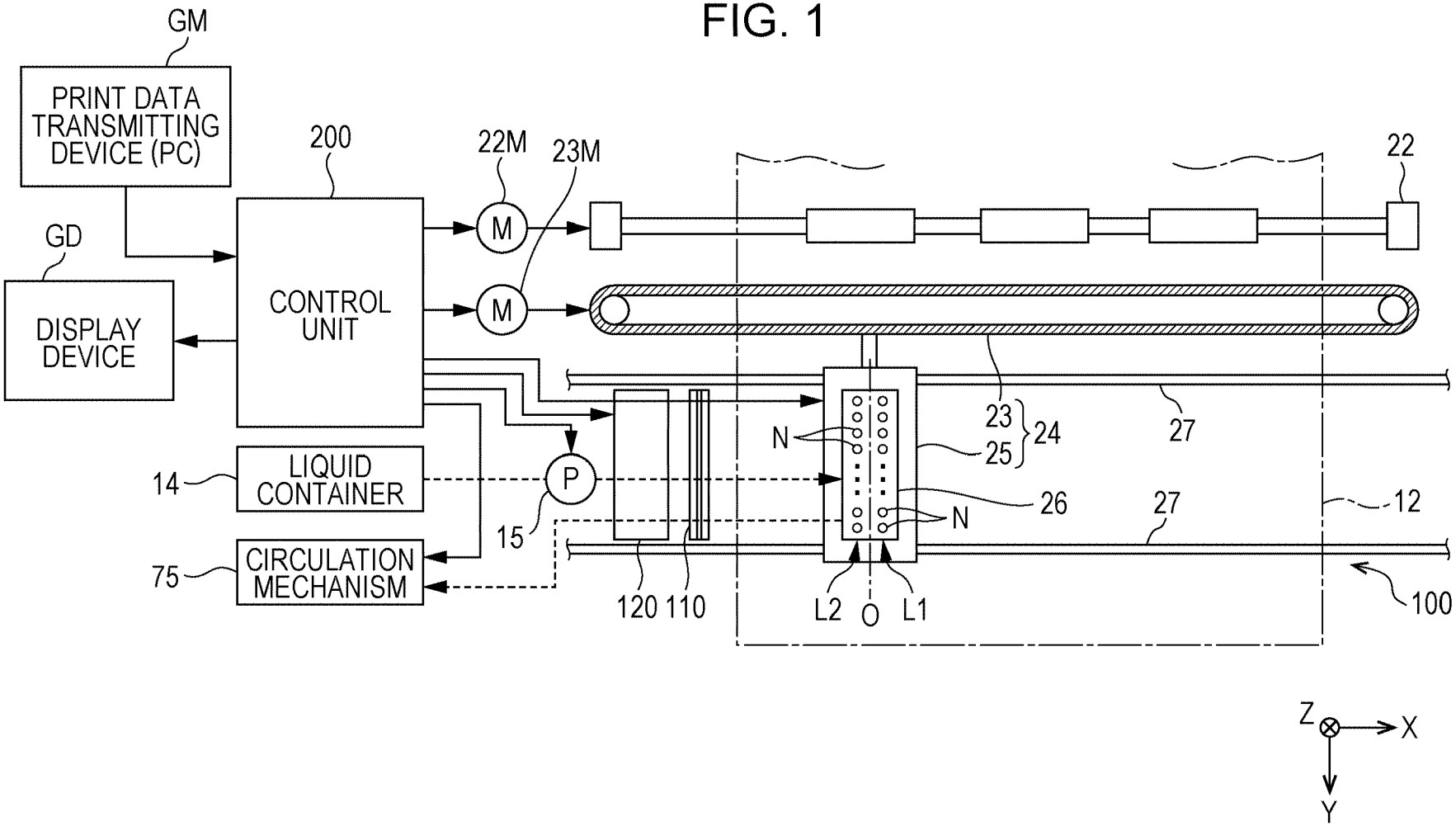
FIG. 1 is an explanatory diagram schematically illustrating a configuration of a liquid ejecting apparatus of a first embodiment of the invention.

FIG. 1 is an explanatory diagram schematically illustrating the configuration of a liquid ejecting apparatus 100 of the first embodiment of the invention. The liquid ejecting apparatus 100 is an ink jet printing apparatus which ejects a droplet of an ink, which is an example of a liquid, onto a medium 12. Hereinafter, the ejection of a droplet of the ink will be referred to simply as the ink ejection. The liquid ejecting apparatus 100 uses a printing target of a predetermined material such as, in addition to printing paper, a resin film or a fabric as the medium 12. The liquid ejecting apparatus 100 performs printing on various media 12 based on print data which is input from a print data transmitting device GM such as a personal computer (PC) or a digital camera (DC), for example. An X direction illustrated in FIG. 1 onward is a transport direction (a main scanning direction) of a liquid ejecting head 26 (described later), a Y direction is a medium feeding direction (a sub-scanning direction) which orthogonally intersects the main scanning direction, and a Z direction is an ink ejection direction which orthogonally intersects an XY plane. In the description hereinafter, for the convenience of explanation, the main scanning direction will be referred to as a printing direction, as appropriate. In a case in which the orientation is to be specified, the direction notation will be accompanied by a positive or negative symbol, where the depicted direction is + (positive).

The liquid ejecting apparatus 100 is provided with a liquid container 14, a transport mechanism 22 which feeds out the medium 12, a control unit 200, a head movement mechanism 24, the liquid ejecting head 26 corresponds to a print head, a first recovery mechanism 110, and a second recovery mechanism 120. The first recovery mechanism 110 and the second recovery mechanism 120 are arranged outside of a liquid ejection region of the medium 12, that is, are arranged outside of the ink ejection region, and are used in the recovery from the ink ejection faults of nozzles N as described later.

The liquid container 14 individually stores a plurality of types of the ink which are ejected from the liquid ejecting head 26. It is possible to use a bag-form ink pack which is formed by a flexible film, an ink tank which may be filled with the ink, or the like as the liquid container 14.

The control unit 200 includes a processing circuit such as a central processing unit (CPU) or a field programmable gate array (FPGA) and a memory circuit such as semiconductor memory and performs overall control of the transport mechanism 22, the head movement mechanism 24, the liquid ejecting head 26, and the like. The control unit 200 corresponds to the controller in the invention and, based on the print data which is input from the print data transmitting device GM, performs the ink ejection from the nozzles N (described later), ink supplying from the liquid container 14, and various text displays and image displays on a display device GD such as a liquid crystal display. A description will be given later of the various control performed by the control unit 200 and device configurations in relation to the ejecting and the supplying of the ink.

The transport mechanism 22 is provided with a motor 22M and feeds out the medium 12 in the +Y direction using motor driving based on control signals from a motor driver (not illustrated) which is included in the control unit 200. The transport mechanism 22 also corresponds to a discharging mechanism of the invention which discharges the medium 12 to the outside of the ejection region of the ink. A description will be given later of the configuration of the control unit relating to the ink ejection.

The head movement mechanism 24 is provided with a transport belt 23, a carriage 25, and a motor 23M for belt driving. The transport belt bridges along the print range of the medium 12 in the X direction and the carriage 25 stores the liquid ejecting head 26 and fixes the liquid ejecting head 26 to the transport belt 23. The head movement mechanism 24 causes the liquid ejecting head 26 to move together with the carriage 25 reciprocally in the main scanning direction (the X direction) using forward and backward driving of the motor 23M based on the control signal from the motor driver (not illustrated) which is included in the control unit 200. The carriage 25 moves reciprocally along the main scanning direction while being guided by guide rails 27. A head configuration in which a plurality of the liquid ejecting heads 26, one for each ink type which is stored in the liquid container 14, is installed on the carriage 25, a head configuration in which the liquid container 14 is installed on the carriage 25 together with the liquid ejecting head 26, or the like may be adopted.

The liquid ejecting head 26 ejects the ink which is supplied from the liquid container 14 from the plurality of nozzles N toward the medium 12 under the control of the control unit 200. The printing of a desired image or the like onto the medium 12 is performed by the ink ejection from the nozzles N during the reciprocal movement of the liquid ejecting head 26. As illustrated in FIG. 1, the liquid ejecting head 26 is provided with nozzle rows in which the plurality of nozzles N is lined up along the sub-scanning direction and there are two of the nozzle rows separated by a predetermined interval along the main scanning direction. The two nozzle rows are depicted as a first nozzle row L1 and a second nozzle row L2 in the drawings and the nozzles N of the first nozzle row L1 and the nozzles N of the second nozzle row L2 are provided to line up in the main scanning direction. In the following explanation, a YZ plane which includes a center axis, which is obtained by using a center of the first nozzle row L1 and the second nozzle row L2 as the center axis, and passes through the Y direction is set to a central surface O for the convenience of explanation. The arrangement of the nozzles N in the first nozzle row L1 and the second nozzle row L2 may also be a zig-zag arrangement which is deviated in the medium feeding direction (the Y direction). Although the first nozzle row L1 and the second nozzle row L2 are nozzle rows corresponding to a plurality of types of ink which are provided in the liquid container 14, this is not depicted.

Figure 2:
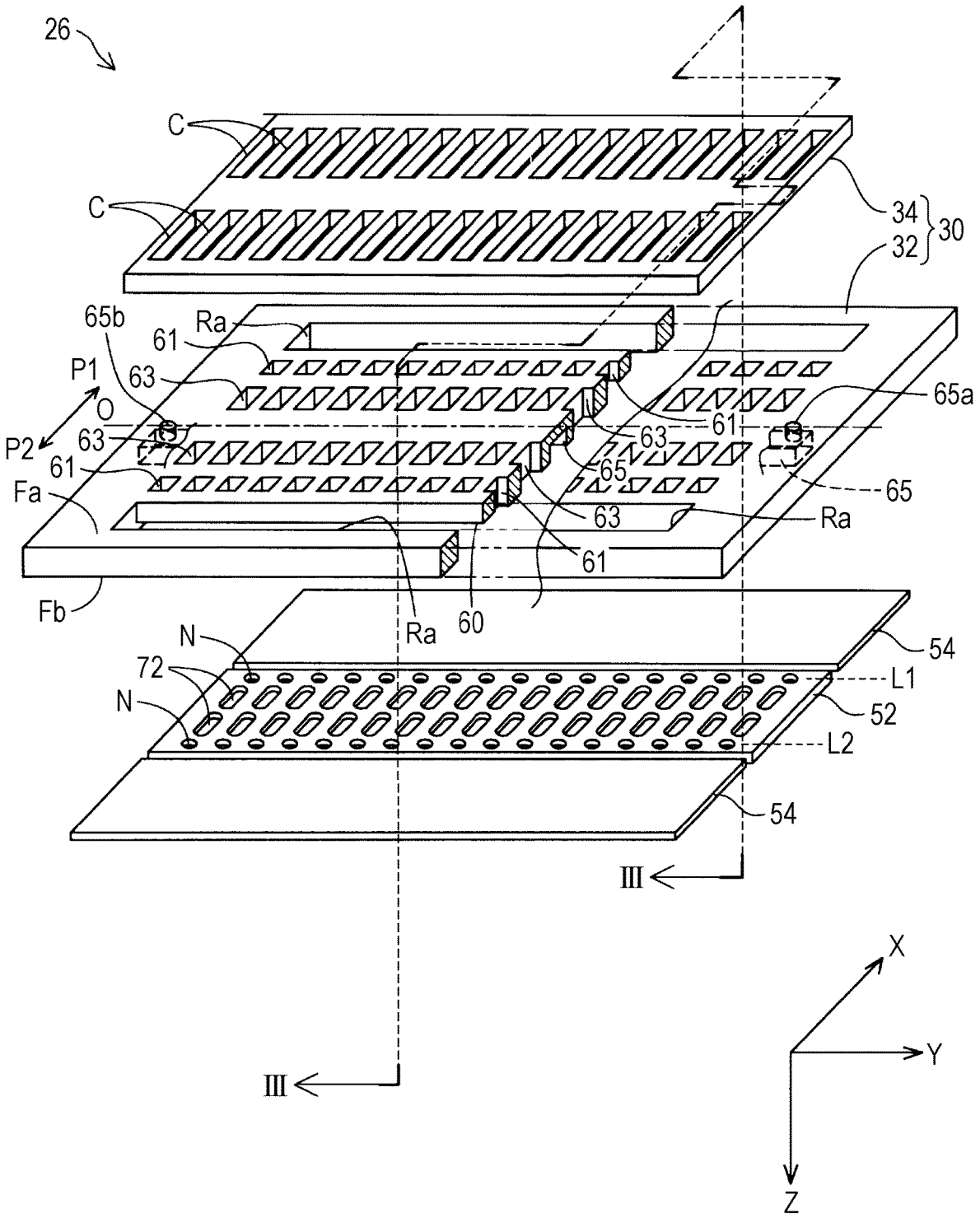
FIG. 2 is an exploded explanatory diagram illustrating main head configuration materials of a liquid ejecting head.
Figure 3:
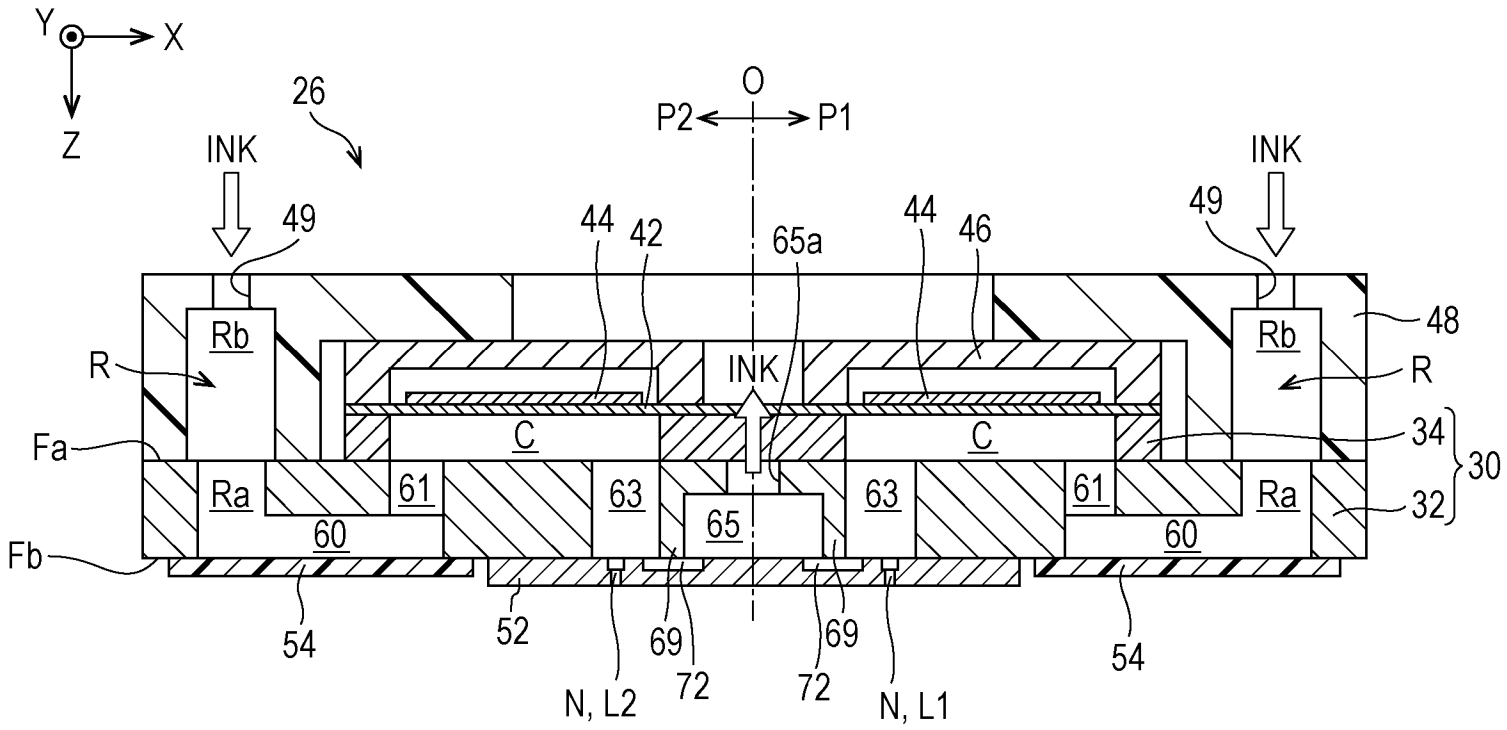
FIG. 3 is a sectional explanatory diagram illustrating the liquid ejecting head taken along a III-III line in FIG. 2.

The liquid ejecting head 26 which includes the first nozzle row L1 and the second nozzle row L2 is a laminated body in which head configuration materials are laminated. FIG. 2 is an exploded explanatory diagram illustrating the main head configuration materials of the liquid ejecting head 26. FIG. 3 is a sectional explanatory diagram illustrating the liquid ejecting head 26 taken along a III-III line in FIG. 2. The thickness of each depicted configuration member does not indicate the actual configuration material thickness. In FIG. 2, for the purpose of depiction, some parts of a first flow path substrate 32 which is a configuration material are omitted.

As illustrated, the liquid ejecting head 26 is provided with a configuration relating to the nozzles N of the first nozzle row L1 and a configuration relating to the nozzles N of the second nozzle row L2 symmetrically interposing the central surface O. In other words, in the liquid ejecting head 26, a first portion P1 of the +X direction side and a second portion P2 of the −X direction side which interpose the central surface O have a common configuration. The nozzles N of the first nozzle row L1 belong to the first portion P1, the nozzles N of the second nozzle row L2 belong to the second portion P2, and the central surface O is a boundary plane between the first portion P1 and the second portion P2.

As the main head configuration materials, the liquid ejecting head 26 is provided with a flow path forming portion 30 which contributes to the flow path formation in the head, and a housing portion 48 which contributes to the supplying and discharging of the ink. The flow path forming portion 30 is configured by laminating the first flow path substrate 32 and a second flow path substrate 34. Both of the substrates of the first flow path substrate 32 and the second flow path substrate 34 are plate bodies which are long in the Y direction and the second flow path substrate 34 is fixed to a top surface Fa of the first flow path substrate 32 in the −Z direction using an adhesive.

A vibrating portion 42, a plurality of piezoelectric elements 44, a protective member 46, and the housing portion 48 are installed on the top surface Fa side on the first flow path substrate 32. The vibrating portion 42 is installed to bridge from the first portion P1 to the second portion P2 and is a plate body having a thin shape which is long in the Y direction. The protective member 46 installed to bridge from the first portion P1 to the second portion P2 and is a plate body which is long in the Y direction. The protective member 46 forms a recessed space on the top surface side of the vibrating portion 42 and covers the vibrating portion 42. The housing portion 48 is a plate body which is long in the Y direction. The housing portion 48 pinches the protective member 46 against the second flow path substrate 34 of the flow path forming portion 30 on both sides of the central surface O. Additionally, a nozzle plate 52 and vibration absorbing bodies 54 are disposed on a bottom surface Fb of the first flow path substrate 32 in the Z direction. The nozzle plate 52 and the vibration absorbing bodies 54 are all plate bodies which are long in the Y direction. The nozzle plate 52 is installed to bridge from the first portion P1 to the second portion P2. The vibration absorbing bodies 54 are installed individually on the first portion P1 and the second portion P2. Each of these elements adheres to a respective location on the top surface Fa or the bottom surface Fb of the first flow path substrate 32 using an adhesive.

As illustrated in FIG. 2, the nozzle plate 52 is provided with the nozzles N of the first portion P1 and the nozzles N of the second portion P2 in rows and is provided with two rows of circulation paths 72 between the first nozzle row L1 in which the nozzles N of the first portion P1 are lined up and the second nozzle row L2 in which the nozzles N of the second portion P2 are lined up. Each of the nozzles N is a circular through-hole which ejects the ink. As illustrated in FIG. 3, the circulation paths 72 are sunk grooves which are formed in the surface of the nozzle plate 52. The circulation paths 72 of the +X direction row correspond to the nozzles N in the first nozzle row L1 and the circulation paths 72 of the −X direction row correspond to the nozzles N in the second nozzle row L2. As illustrated in FIG. 3, the nozzle plate 52 is formed to include the nozzles N and the circulation paths 72 after applying a semiconductor manufacturing technique, for example, a processing technique such as dry etching or wet etching to a single crystal substrate of silicon (Si). A description will be given later of the state of the ink ejection from the nozzles N and the state of ink collection which uses the circulation paths 72.

The vibration absorbing bodies 54 form the base surface of the liquid ejecting head 26 together with the nozzle plate 52 and close ink inflow chambers Ra and supply liquid chambers 60 as well as supply paths 61 through the adherence of the vibration absorbing bodies 54 to the bottom surface Fb of the first flow path substrate 32. The vibration absorbing bodies 54 is formed from flexible films which absorb pressure fluctuations in the ink inflow chambers Ra, for example, compliance substrates.

The first flow path substrate 32, which is the adhesion target of the nozzle plate 52 and the vibration absorbing bodies 54, forms the ink inflow chambers Ra, the supply liquid chambers 60, the supply paths 61, and communicating paths 63 in association with the first portion P1 and the second portion P2 and forms a discharge liquid chamber 65 to be shared by the first portion P1 and the second portion P2. As illustrated in FIG. 2, the ink inflow chambers Ra are penetrating openings which are long along the Y direction and each of the ink inflow chambers Ra is used in common for the ink supplying by the nozzles N in the first nozzle row L1 and the nozzles N in the second nozzle row L2, respectively. The supply paths 61 and the communicating paths 63 are through-holes which are formed for each of the nozzles N in the first nozzle row L1 and the second nozzle row L2. As illustrated in FIG. 3, in each of the supply liquid chambers 60, a longitudinal sunk groove, which is formed in the bottom surface Fb of the first flow path substrate 32 adjacent to the ink inflow chamber Ra so as to go along the Y direction, is formed to be blocked together with the ink inflow chamber Ra and the supply path 61 by the adherence of the vibration absorbing bodies 54 to the bottom surface Fb of the first flow path substrate 32. The supply liquid chamber 60 contributes to the ink supplying from the ink inflow chamber Ra to the supply paths 61 of each of the nozzles N.

As illustrated in FIG. 2, in the discharge liquid chamber 65, a sunk groove, which is formed in the bottom surface Fb of the first flow path substrate 32 to be long along the Y direction, is formed to be blocked together with the communicating paths 63 by the adhesion of the nozzle plate 52 to the bottom surface Fb of the first flow path substrate 32. The nozzle plate 52 is provided with each of the nozzles N of the first nozzle row L1 and the second nozzle row L2 and the circulation paths 72 corresponding to each of the nozzles N from each of the nozzle rows. Each of the nozzles N is installed at a position which overlaps the corresponding communicating path 63 in plan view from the Z direction. The circulation paths 72 are installed at positions which overlap partitioning wall portions 69 for each nozzle row which partition the communicating paths 63 and the discharge liquid chamber 65 in plan view from the Z direction. The circulation paths 72 form ink flow paths which span the partitioning wall portions 69 through the adhesion of the nozzle plate 52 to the bottom surface Fb of the first flow path substrate 32 and communicate the communicating paths 63 of each of the nozzles N with the discharge liquid chamber 65. Due to being communicated by the circulation paths 72, the discharge liquid chamber 65 receives an inflow of the ink from the communicating paths 63 of each of the nozzles N and contributes to the ink collection.

As illustrated in FIG. 2, the discharge liquid chamber 65 is a sunk groove which is longer than the nozzles N which are lined up in the first nozzle row L1 and the second nozzle row L2 and includes ink discharge ports 65*a* and 65*b* on both ends of the groove. The ink discharge ports 65*a* and 65*b* are through-holes which penetrate the base wall of the discharge liquid chamber 65 of the sunk groove, that is, the first flow path substrate 32 and are connected to circulation tubes in a circulation mechanism 75 (described later). After flowing into the communicating paths 63, the ink passes through the circulation paths 72, enters the discharge liquid chamber 65, and is discharged from the liquid ejecting head 26 through the ink discharge ports 65*a* and 65*b* of the discharge liquid chamber 65. Since the ink which is discharged in this manner enters pressure chambers C (described later), a circulation flow path of the ink is formed between the circulation paths 72 which are downstream of the communicating paths 63 and the discharge liquid chamber 65.

The second flow path substrate 34 which adheres to the top surface Fa of the first flow path substrate 32 forms the pressure chambers C in association with the first portion P1 and the second portion P2. The pressure chambers C are through-holes which go along the X direction and are formed for each of the nozzles N of the first nozzle row L1 and the second nozzle row L2 and communicate with the supply paths 61 and the communicating paths 63 of the first flow path substrate 32 on the bottom end side of the through-holes in the +Z direction. The pressure chambers C are closed at the through-hole top end side in the −Z direction by the vibrating portion 42 which is pinched by the protective member 46. The pressure chambers C which are closed in this manner functions as cavities for each of the nozzles N of the first nozzle row L1 and the second nozzle row L2. The first flow path substrate 32 and the second flow path substrate 34 are formed by subjecting a silicon single crystal substrate to a semiconductor manufacturing technique which is already described in the same manner as the nozzle plate 52.

Figure 4:
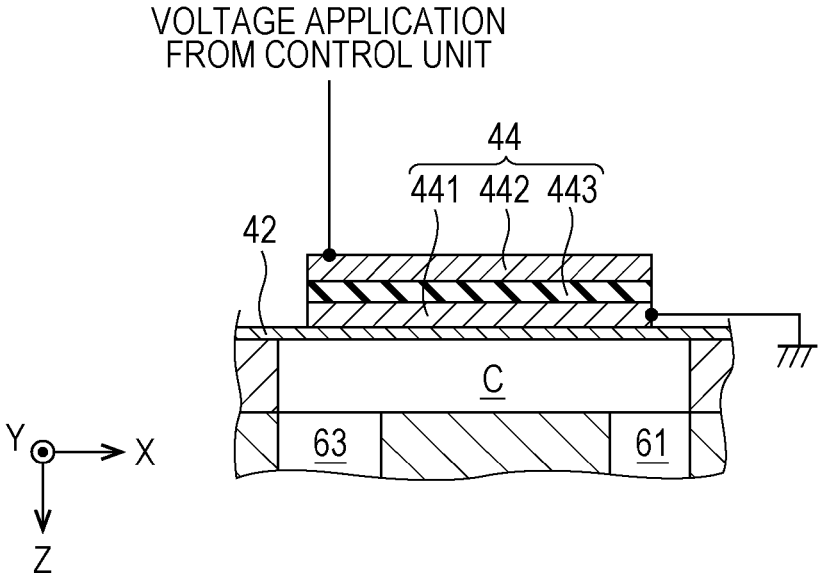
FIG. 4 is an explanatory diagram schematically illustrating a schematic configuration of a piezoelectric element.

The vibrating portion 42 which is pinched between the second flow path substrate 34 and the protective member 46 is a plate-shaped member capable of elastic vibration and is provided with the piezoelectric elements 44 for each of the pressure chambers C which are closed in this manner. Accordingly, each of the piezoelectric elements 44 corresponds to the individual nozzles N of the first nozzle row L1 and the second nozzle row L2. The piezoelectric elements 44 correspond to a pressure generating unit in the invention. FIG. 4 is an explanatory diagram schematically illustrating the schematic configuration of the piezoelectric element 44. The piezoelectric elements 44 are elements which receive drive signals from the control unit 200 and deform and are installed on the vibrating portion 42 corresponding to the nozzles N which are lined up. The piezoelectric elements 44 for each of the nozzles extend in the X direction to overlap the pressure chambers C. Each of the piezoelectric elements 44 is a laminated structural body in which a second electrode 442 is laminated on a first electrode 441, which is adhered to the vibrating portion 42, via a piezoelectric layer 443 which has insulating properties. The first electrode 441 is earthed and the second electrode 442 receives a series of liquid ejection requests from the control unit 200, in the present embodiment, the second electrode 442 receives the application of voltages individually corresponding to a series of printing requests which are necessary for printing an entire printing region. According to the application of the voltages, the piezoelectric element 44 flexes in the Z direction to cause a vibration in the Z direction and causes a pressure change in the ink which is already supplied to the pressure chamber C, in detail, in the ink which is passing through the pressure chamber C. The pressure change extends to the nozzle N through the communicating path 63. The first electrode 441 may be a common electrode to the piezoelectric elements 44 which are included in the first nozzle row L1, or alternatively, may be a common electrode to the piezoelectric elements 44 which are included in the second nozzle row L2.

The piezoelectric element 44 receives a residual vibration which is caused by the ink of the pressure chamber C and vibrates during the period from when the piezoelectric element 44 receives the application of a voltage and vibrates until the piezoelectric element 44 receives the application of a voltage at a drive timing corresponding to the next printing request. During this period, since the piezoelectric element 44 does not receive a voltage application, the piezoelectric element 44 functions as an electrostatic actuator in which the first electrode 441 and the second electrode 442, which are good conductors, face each other separated by the piezoelectric layer 443 which has insulating properties. Accordingly, during the period in which the piezoelectric element 44 receives the residual vibration of the ink and performs a flexural vibration in the Z direction, the piezoelectric element 44 causes an increasing or a decreasing change in the electrostatic capacity corresponding to the flexural vibration of the piezoelectric element 44 itself. It is possible to detect the vibration transition of the residual vibration which occurs in the ink of the pressure chamber C by inputting the electrostatic capacity change into a vibration generating circuit (described later). A detailed description of this point will be given later.

The protective member 46 is a plate-shaped member for protecting the piezoelectric elements 44 which are present for each of the pressure chambers C and is pinched by the first flow path substrate 32 and the housing portion 48 in a state of pinching the vibrating portion 42 between the protective member 46 and the second flow path substrate 34. In the same manner as the first flow path substrate 32 and the second flow path substrate 34, it is possible to form the protective member 46 by subjecting a silicon single crystal substrate to a semiconductor manufacturing technique which is already described, or alternatively, the protective member 46 may be formed by another material. The housing portion 48 is a member which covers the top surface side of the liquid ejecting head 26 and contributes to the protection of the overall head, to the storage of the ink which is supplied to the pressure chambers C which are present for each of the nozzles N, and to the ink refilling from the liquid container 14 (refer to FIG. 1). In other words, the housing portion 48 is provided with upstream side ink inflow chambers Rb which overlap the ink inflow chambers Ra of the first flow path substrate 32 in the Z direction and form ink storage chambers (reservoirs R) having common liquid chambers using the upstream side ink inflow chambers Rb and the ink inflow chambers Ra of the first flow path substrate 32. The ink supplying to the upstream side ink inflow chambers Rb is performed from ink inlets 49 of inflow chamber ceiling walls. The housing portion 48 is formed using injection molding of a suitable resin material.

Figure 5:
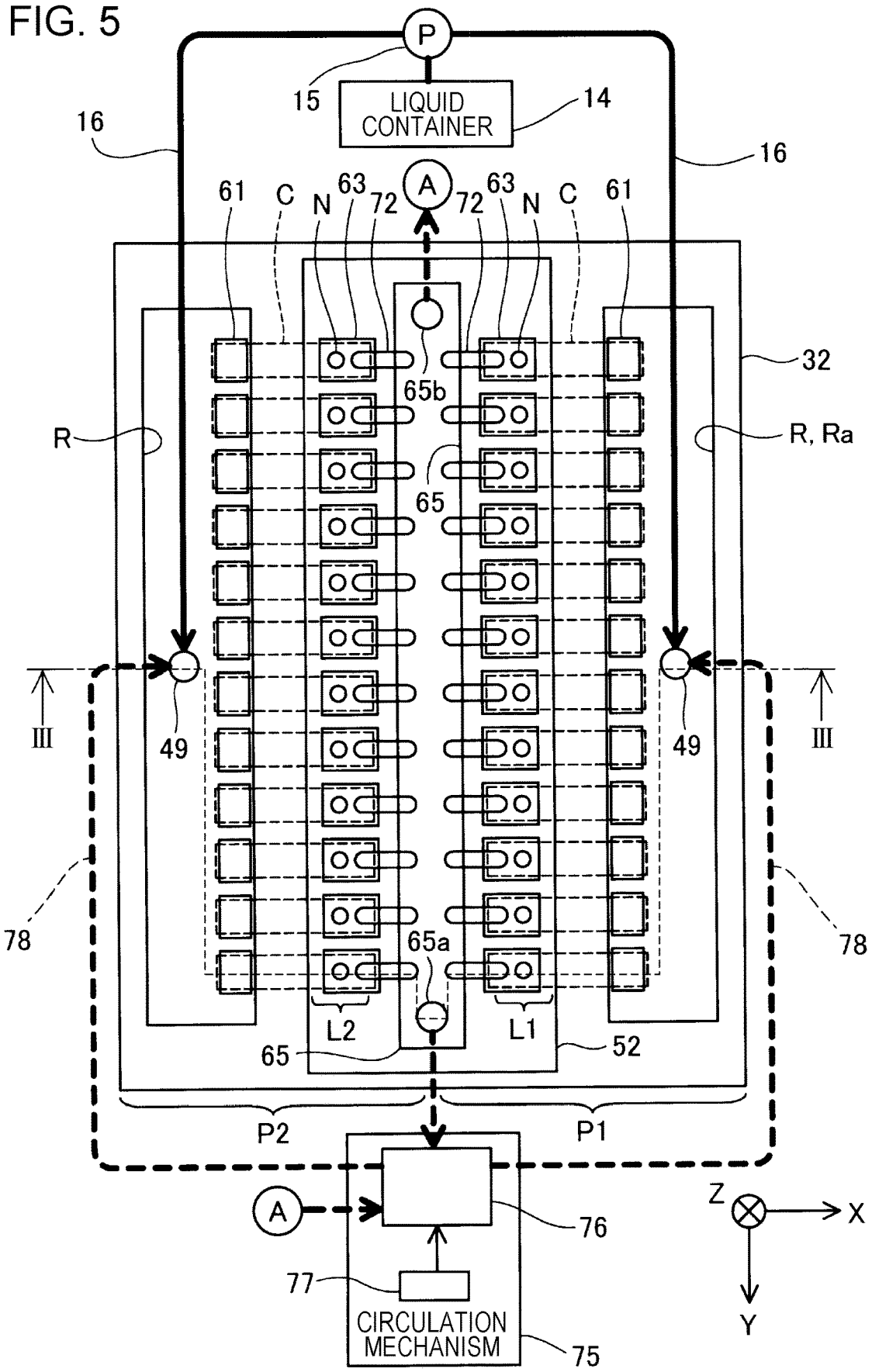
FIG. 5 is an explanatory diagram illustrating ink supply paths to nozzles and paths of ink circulation overlapping various flow path forming portions such as supply paths in the liquid ejecting head.

FIG. 5 is an explanatory diagram illustrating ink supply paths to the nozzles N and paths of ink circulation overlapping various flow path forming portions such as the supply paths 61 in the liquid ejecting head 26. In FIG. 5, the various path forming portions in the liquid ejecting head 26 are illustrated overlapping as viewed from the + +Z-axis direction. In FIG. 5, supply tubes 16 which go from the liquid container 14 to the ink inlets 49 and the tracks of collection tubes 78 which go from the discharge liquid chamber 65 to the circulation mechanism 75 (described later) are schematically illustrated including the installation positions of the liquid container 14 and the circulation mechanism 75. The III-III line illustrated in FIG. 5 indicates the cross-section plane of FIG. 3 corresponding to the III-III line illustrated in FIG. 2.

As illustrated, the reservoirs R which are configured by the ink inflow chambers Ra and the supply liquid chambers 60 (refer to FIG. 3) in the first flow path substrate 32 extend in the Y direction along each of the nozzle rows of the first nozzle row L1 and the second nozzle row L2. In the first portion P1, the reservoir R overlaps the supply paths 61 which are present for each of the nozzles which correspond to each of the nozzles N in the second nozzle row L2. In the second portion P2, the reservoir R overlaps the supply paths 61 corresponding to each of the nozzles N in the first nozzle row L1. The supply paths 61 of each of the nozzle rows overlap the pressure chambers C which are present for each of the nozzles and the pressure chambers C overlap the communicating paths 63 of each of the nozzle rows. The communicating paths 63 of the first flow path substrate 32 overlap the nozzles N of the nozzle plate 52 illustrated in FIG. 3. Accordingly, the ink from the liquid container 14 is supplied to the reservoirs R by a pump 15 through the supply tubes 16 which are connected to the ink inlets 49.

The ink which receives the pumping pressure of the pump 15 and is stored in the reservoirs R is supplied to the communicating paths 63 via the supply paths 61 and the pressure chambers C, receives the vibrations of the piezoelectric elements 44 which are driven and controlled by the control unit 200 in the pressure chambers C and is ejected from the nozzles N. The ink supplying from the liquid container 14 is continued even in a printing situation in which the ink ejection from the nozzles N is being performed, and even in a situation in which an ink ejection fault (described later), which does not accompany ink ejection from the nozzles N, is detected.

Together with the ink ejection from the nozzles N, the ink is supplied to the reservoirs R via the ink inlets 49 from the liquid container 14 as well as or instead of from the circulation mechanism 75. The circulation mechanism 75 is provided with an ink storage tank 76 and a pressure adjustment unit 77 which adjusts the pressure inside the storage layer to a lower pressure than the pumping pressure of the pump 15. The circulation mechanism 75 receives circulated ink (described later), which is from the discharge liquid chamber 65, from the ink discharge port 65*a* and the ink discharge port 65*b*, and after storing the received circulated ink in the ink storage tank 76, circulates the ink into the reservoirs R via the ink inlets 49. The circulation of the circulated ink to the reservoir R through the ink inlets 49 is performed using the pressure adjustment of the pressure adjustment unit 77 (described later) which is performed on the pumping pressure of the pump 15.

The discharge liquid chamber 65 extends in the Y direction between the first nozzle row L1 and the second nozzle row L2, is provided with the ink discharge port 65*a* further in the +Y direction than the bottommost nozzles N in the +Y direction in the nozzle rows, and is provided with the ink discharge port 65*b* further in the −Y direction than the topmost nozzles N in the −Y direction in the nozzle rows. The discharge liquid chamber 65 overlaps the circulation paths 72 corresponding to each of the nozzles N in the first nozzle row L1 in the first portion P1 and overlaps the circulation paths 72 corresponding to each of the nozzles N in the second nozzle row L2 in the second portion P2. Accordingly, in a situation in which the ink supplying to the pressure chambers C is continued, the ink which exceeds the sum of the internal volume of the pressure chambers C and the communicating paths 63 is pushed out to the discharge liquid chamber 65 via the communicating paths 63 and the circulation paths 72, reaches the circulation mechanism 75 via the ink discharge ports 65*a* and 65*b* as the circulated ink, and is circulated to the reservoirs R by the circulation mechanism 75.

Figure 6:
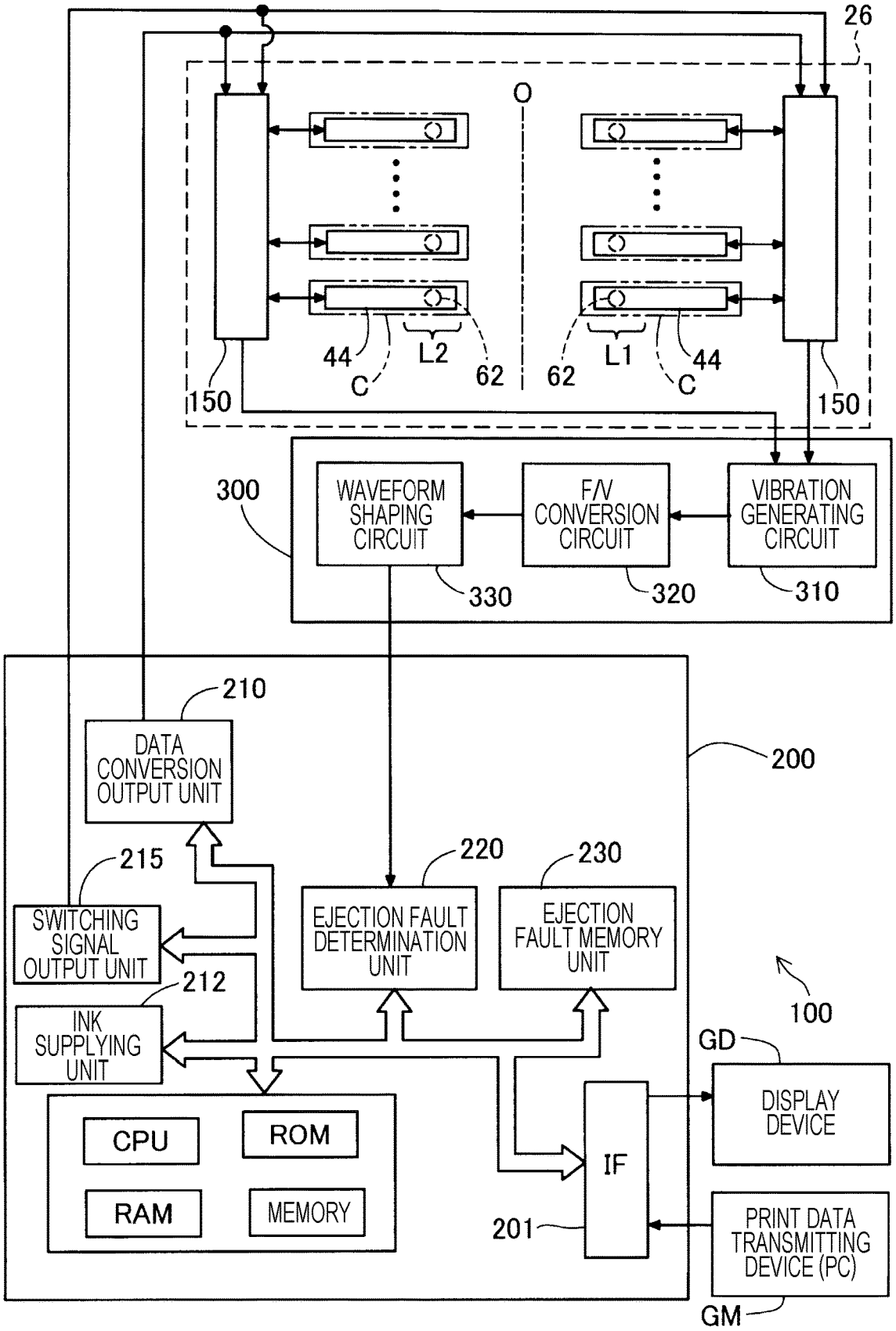
FIG. 6 is a block diagram illustrating a main electrical configuration relating to ink ejection from the nozzles exemplifying the correspondence with the piezoelectric element in each pressure chamber.
Figure 7:
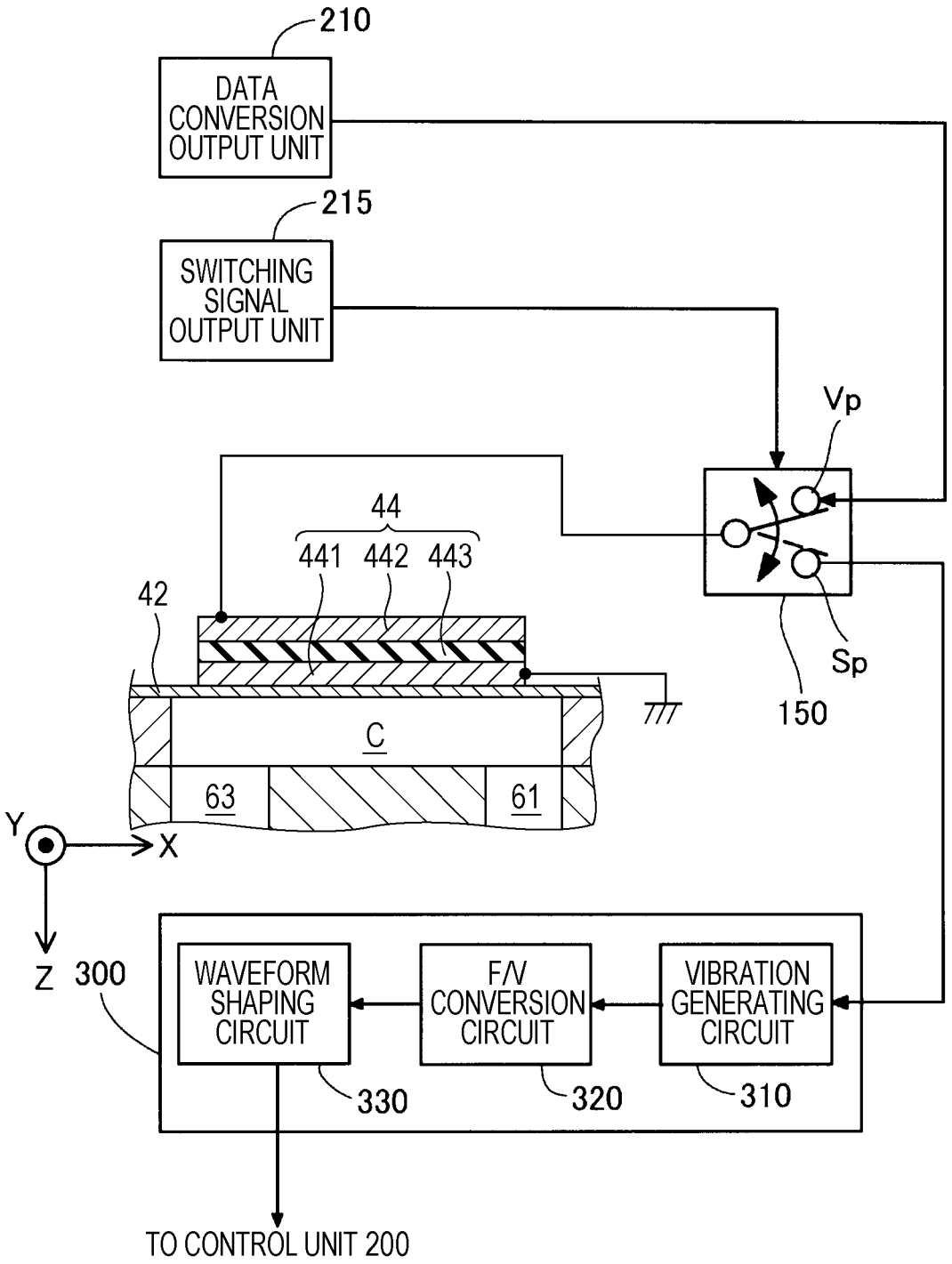
FIG. 7 is a block diagram illustrating the main electrical configuration relating to the ink ejection from the nozzle in association with the configuration of the piezoelectric element.

FIG. 6 is a block diagram illustrating the main electrical configuration relating to ink ejection from the nozzles N exemplifying the correspondence with the piezoelectric element 44 in each of the pressure chambers C. FIG. 7 is a block diagram illustrating the main electrical configuration relating to the ink ejection from the nozzle N in association with the configuration of the piezoelectric element 44. In FIG. 7, in order to illustrate the state of the laminating of the configuration elements of the piezoelectric element 44, the configuration elements are represented with an emphasized thickness.

As illustrated in FIG. 6, the control unit 200 receives an input of the print data from the print data transmitting device GM via an interface 201 (IF in FIG. 6) and outputs a display signal of text or the like to the display device GD via the interface 201. Additionally, in relation to the ink ejection, the control unit 200 is provided with various functional units which are interconnected to a bus. The functional units include an ink supplying unit 212, a data conversion output unit 210, a switching signal output unit 215, an ejection fault determination unit 220, and an ejection fault memory unit 230. These functional units are configured by executing a predetermined program which is stored in memory and the ink supplying unit 212 achieves the circulatory ink supplying to the pressure chambers C. The data conversion output unit 210 converts the print data (the series of printing requests) which is obtained through input from the print data transmitting device GM into voltage application data to the piezoelectric elements 44 for the ink ejection from each of the nozzles N of the first nozzle row L1 and the second nozzle row L2 and applies the voltages to the piezoelectric elements 44 for each of the nozzles N using the converted voltage application data. The switching signal output unit 215 generates signals which switch the piezoelectric elements 44 from a usage for the ink ejection to a usage of detection of the vibration transition of the residual vibration which is caused by the ink in the pressure chambers C after the ink ejection, and conversely, which perform the opposite switching and outputs the switching signal to a switcher 150 (described later). The ejection fault determination unit 220 determines whether or not there is a fault in the liquid ejection from the nozzles N using the vibration transitions of the residual vibration of the pressure chambers C which are obtained via the piezoelectric elements 44 and a residual vibration detection device 300 (described later). The ejection fault memory unit 230 stores the determination result of the ejection fault determination unit 220.

The liquid ejecting apparatus 100 includes the residual vibration detection device 300 in relation to the detection of ink ejection faults. The residual vibration detection device 300 is provided with a vibration generating circuit 310, a voltage-frequency conversion circuit 320 (the F/V conversion circuit in the drawings) which achieves voltage-frequency conversion, and a waveform shaping circuit 330. As illustrated in FIG. 7, the vibration generating circuit 310 is connected to the switcher 150 which handles each of the piezoelectric elements 44. The switcher 150 switches a connection destination of the second electrode 442 in the piezoelectric element 44 to one of an application position Vp and a vibration detection position Sp using the switching signal from the switching signal output unit 215. When connection destination of the second electrode 442 of the piezoelectric element 44 is switched to the vibration detection position Sp which is the vibration generating circuit 310, the vibration generating circuit 310 receives input of an increasing or decreasing change in the electrostatic capacity corresponding to the flexural vibration of the piezoelectric element 44 and vibrates in accordance with the increase or decrease in the electrostatic capacity which is input. The vibration occurs in a CR vibration generating circuit which uses a Schmitt trigger inverter having a hysteresis property as both a condenser (C) and a resistance (R). The voltage-frequency conversion circuit 320 is configured using several switching elements, capacitors, resistance elements, and fixed-current power sources and subjects a generated vibration waveform (a residual vibration waveform) which is output from the vibration generating circuit 310 to voltage-frequency conversion. The waveform shaping circuit 330 is configured using a capacitor for removing a direct current component and several resistance elements, direct current voltage sources, amplifiers, and comparators, converts the residual vibration waveform which undergoes the voltage-frequency conversion of the voltage-frequency conversion circuit 320 to a square wave and outputs the result to the ejection fault determination unit 220 of the control unit 200.

The liquid ejecting apparatus 100 of the present embodiment anticipates a situation in which ink ejection faults from the nozzles N occur, a situation in which bubbles of a size capable of causing the ink ejection faults remain in the pressure chambers C, a situation in which foreign matter of a size capable of causing the ink ejection faults remain in the pressure chambers C, and a situation in which foreign matter such as paper fragments capable of causing the ink ejection faults block the opening regions of the nozzles N. The residual vibration transition of the ink in the pressure chambers C in a situation in which bubbles remain, the residual vibration transition of the ink in the pressure chambers C in a situation in which foreign matter remains, and the residual vibration transition in the pressure chambers C in a situation in which the openings are closed by foreign matter are already ascertained due to experiments carried out in advance. The control unit 200 stores the transitions and periods of the residual vibration waveforms for each of the already ascertained situations in association with the origins of the ink ejection faults in a memory inside the unit or an external memory. The transitions and periods of the residual vibration waveforms are also stored for the ejection faults which are caused by an increase in the viscosity of the ink.

Figure 8:
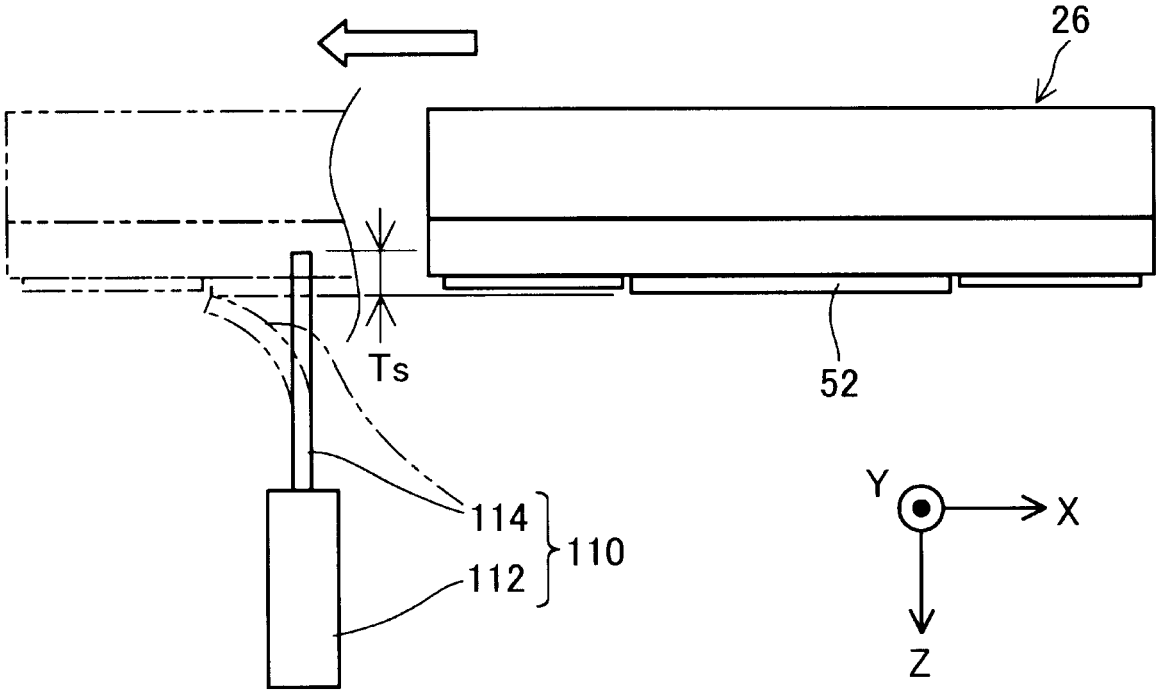
FIG. 8 is an explanatory diagram schematically illustrating a state of recovery from ink ejection faults using a first recovery mechanism which is provided outside of a printing region of a medium.

FIG. 8 is an explanatory diagram schematically illustrating a state of recovery from ink ejection faults using the first recovery mechanism 110 which is provided outside of a printing region of the medium 12. As illustrated, the first recovery mechanism 110 is provided with a wiping member 114 which protrudes from a main body 112. The wiping member 114 has a brush structure which uses flexible rubber members or wires and performs the wiping for the recovery from the ejection faults. The first recovery mechanism 110 is ordinarily positioned closer to the +Z direction side than the liquid ejecting head 26. In a situation in which the ink ejection faults are to be recovered from using the wiping, the control unit 200 raises the first recovery mechanism 110 and causes the wiping member 114 to protrude from the nozzle plate 52 in the liquid ejecting head 26. In this case, the wiping member 114 itself may be raised in the −Z direction, or alternatively, the entirety of the first recovery mechanism 110 may be raised. In a state in which the wiping member 114 protrudes from the nozzle plate 52 by a protrusion length Ts, the control unit 200 causes the liquid ejecting head 26 to move in the −X direction. Accordingly, the wiping member 114 wipes the bottom surface of the nozzle plate 52 while bending as illustrated and the foreign matter such as paper fragments which adhere to the bottom surface of the nozzle plate 52 and block the openings of the nozzles N (refer to FIG. 3) are removed. The foreign matter removal may be performed using the first recovery mechanism 110 while causing the liquid ejecting head 26 to move reciprocally along the X direction. The first recovery mechanism 110, which recovers from the ejection faults of the ink from the nozzles N through wiping using the wiping member 114, corresponds to a recovery unit in the invention.

Figure 9:
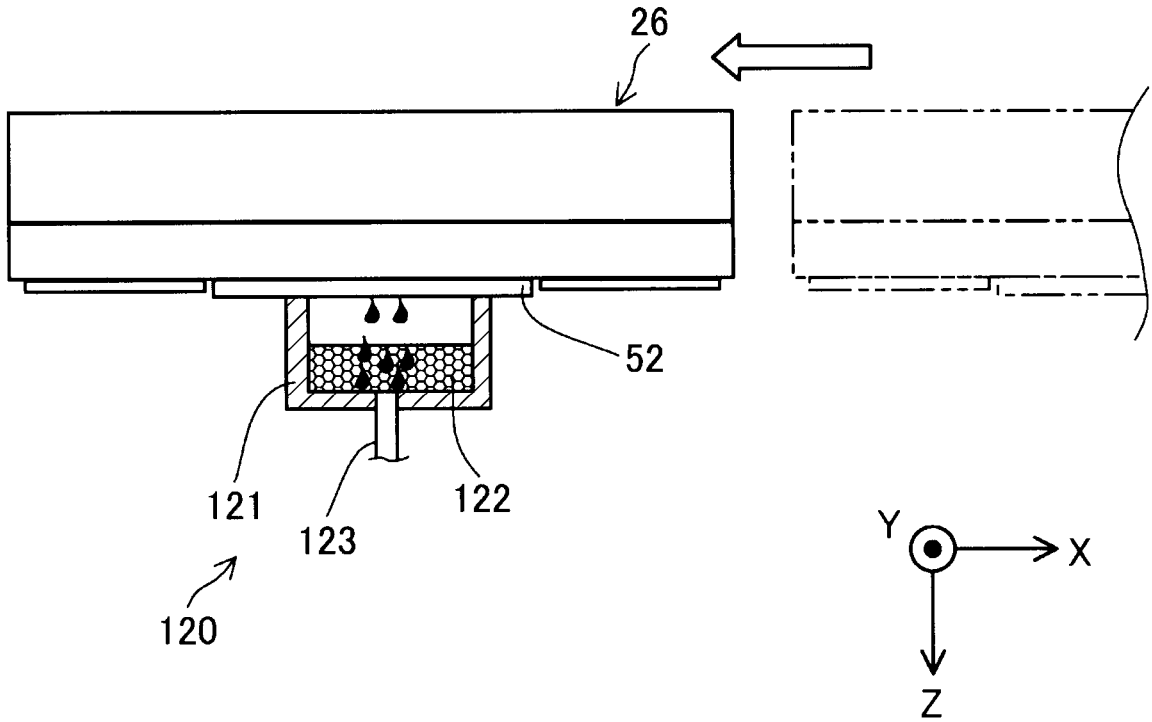
FIG. 9 is an explanatory diagram schematically illustrating a state of recovery from ink ejection faults using a second recovery mechanism which is provided outside of the printing region of the medium.

FIG. 9 is an explanatory diagram schematically illustrating a state of recovery from ink ejection faults using the second recovery mechanism 120 which is provided outside of the printing region of the medium 12. As illustrated, the second recovery mechanism 120 stores an ink absorbing material 122 in an opening container 121 and is provided with an ink discharging tube 123 which is connected to the base wall of the opening container 121 for suctioning the inside of the container and discharging the ink which is absorbed by the ink absorbing material 122. The ink absorbing material 122 is formed from a non-woven fabric or a sponge cloth and absorbs and holds the ink which is ejected from the nozzles N. The second recovery mechanism 120 suctions (pumps) the inner portion of the opening container 121 using a suction pump (not illustrated) and discharges the ink which is absorbed and held by the ink absorbing material 122 through the ink discharging tube 123 which is connected to the base wall of the opening container 121.

The second recovery mechanism 120 is ordinarily positioned closer to the +Z direction side than the liquid ejecting head 26. The control unit 200 causes the liquid ejecting head 26 to move to the outside of the printing region and stops the movement in a situation in which the ink ejection faults are to be recovered from by popping or flushing. Subsequently, the control unit 200 raises the opening container 121 of the second recovery mechanism 120 and covers, in an airtight manner, the entirety (refer to FIG. 5) of the nozzles N of the first nozzle row L1 and the second nozzle row L2 in the nozzle plate 52 with the opening of the opening container 121. The control unit 200 suctions the inside of the container of the opening container 121 while achieving the ink supplying to the pressure chambers C of the liquid ejecting head 26 during the popping. Due to the popping, the bubbles and foreign matter which cause the faults in the ink ejection by remaining in the pressure chambers C and the communicating paths 63 downstream thereof are taken out by the ink which flows in the pressure chambers C. At this time, the piezoelectric elements 44 of the pressure chambers C may be driven. During the flushing, the control unit 200 drives the piezoelectric elements 44 of the pressure chambers C while achieving the ink supplying to the pressure chambers C of the liquid ejecting head 26 in a situation in which the opening container 121 is not suctioned such that a greater amount of the ink is ejected than the ink ejection amount during the printing. Due to the flushing, the bubbles and foreign matter which cause the faults in the ink ejection by remaining in the pressure chambers C and the communicating paths 63 downstream thereof are taken out by the ink which flows in the pressure chambers C. The second recovery mechanism 120, which recovers from the ejection faults of the ink from the nozzles N through popping or flushing, corresponds to a recovery unit in the invention.

A-2. Ejection Related Control

Figure 10:
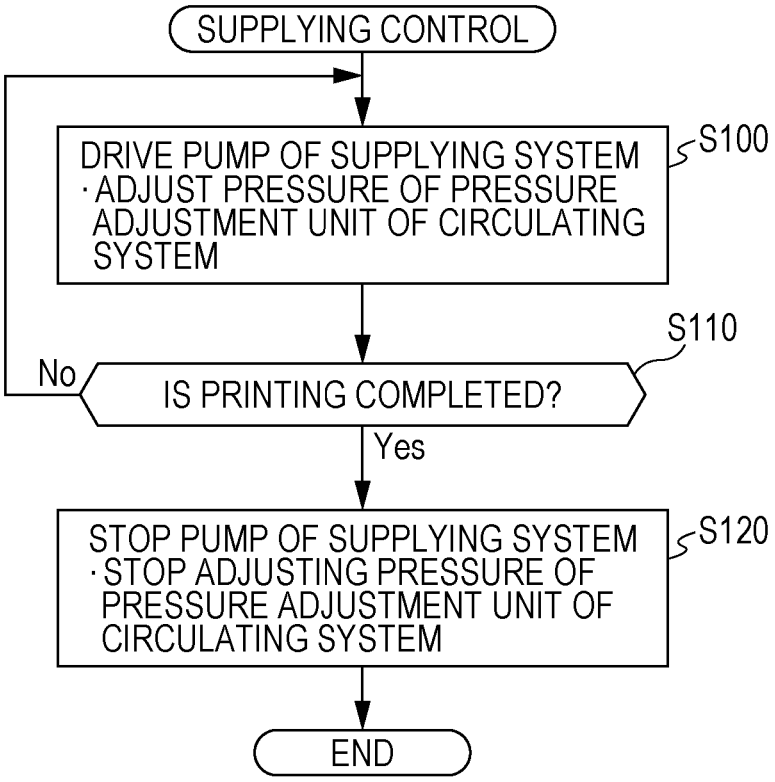
FIG. 10 is a flowchart illustrating a procedure of supplying control which achieves ink supplying to the liquid ejecting head.

FIG. 10 is a flowchart illustrating a procedure of supplying control which achieves ink supplying to the liquid ejecting head 26. The supplying control is repeatedly executed by the ink supplying unit 212 of the control unit 200 while the printing is being performed by the liquid ejecting apparatus 100. First, the ink supplying unit 212 drives an ink supplying system from the liquid container 14 to the liquid ejecting head 26, specifically, the pump 15 of the supply tubes 16 at a predetermined pumping pressure and adjusts the pressure of the pressure adjustment unit 77 in the circulation mechanism 75 (step S100). Accordingly, the ink is supplied to each of the pressure chambers C through the reservoirs R and the supply liquid chambers 60 and the supply paths 61, and the ink which passes through the pressure chambers C is collected by the circulation mechanism 75 through the communicating paths 63, the circulation paths 72, and the discharge liquid chamber 65.

Next, the ink supplying unit 212 determines whether or not printing which is suitable for the series of printing requests which are obtained by receiving transmissions from the print data transmitting device GM is completed (step S110) and continues the ink supplying and collection to the pressure chambers C until the printing is completed. Meanwhile, when it is determined that the printing is completed, the ink supplying unit 212 also stops adjusting the pressure of the pressure adjustment unit 77 in addition to stopping the pump 15 (step S120) and ends the supplying control routine. Through the supplying control, over the period in which the series of printing requests which request the ink ejection from the nozzles N is present, the ink supplying to the plurality of pressure chambers C and the collection of the ink which passes through the pressure chambers C are continued. Accordingly, together with the liquid container 14 and the circulation mechanism 75, the supplying control and the ink supplying unit 212 which executes the supplying control configure a liquid supplying unit in the invention. The ink supplying unit 212 may also temporarily stop the ink supplying. For example, if the user cancels the printing, the ink supplying unit 212 temporarily stops the ink supplying and restores the ink supplying and collection in accordance with an instruction to clear the cancel or to restart the printing. As in the wiping for recovering from the ejection faults of the ink, if the ink supplying is unnecessary, the ink supplying may be temporarily stopped during the wiping and the ink supplying and the collection may be restored through the completion of the wiping. It is possible to also perform the wiping in the ink supplying.

Figure 11:
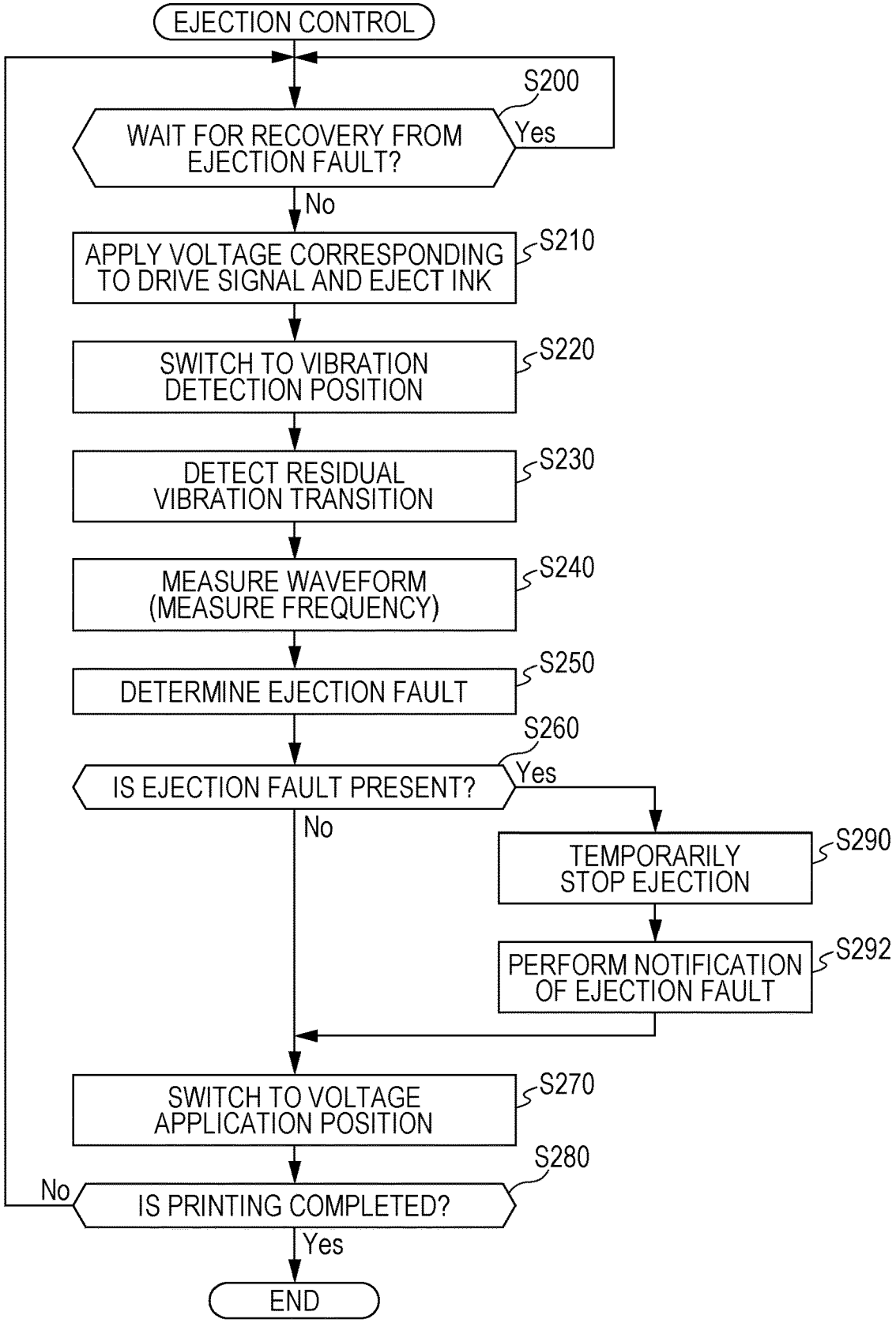
FIG. 11 is a flowchart illustrating a procedure of ejection control which accompanies detection of the ejection faults of the ink.

FIG. 11 is a flowchart illustrating a procedure of ejection control which accompanies detection of the ejection faults of the ink. The ejection control is executed repeatedly by the control unit 200 accompanying the outputting of the print data by the data conversion output unit 210, the switching of the switcher 150 by the switching signal output unit 215, the ejection fault determination by the ejection fault determination unit 220, and the waveform shaping in the residual vibration detection device 300 in the period in which the printing is being performed by the liquid ejecting apparatus 100. Additionally, the ejection control is individually executed for each of the individual piezoelectric elements 44 using the piezoelectric elements 44 in each of the pressure chambers C of the first nozzle row L1 and the second nozzle row L2 as control targets. Before the starting of the ejection control, the switcher 150 is switched by the switching signal output unit 215 to the application position Vp at which the voltages are applied to the piezoelectric elements 44 in each of the pressure chambers C. In other words, the initial state of the switcher 150 is the application position Vp.

First, the control unit 200 determines (step S200) whether the current point in time is a recovery waiting situation of ejection faults accompanying a temporary stopping of the ink ejection according to step S290 (described later). When there is an ejection fault in a certain nozzle N in the following process of the ejection control, upon temporarily stopping the ink ejection for the nozzle N, the liquid ejecting apparatus 100 of the present embodiment continues the ink supplying and collection to the specific nozzle, and upon continuing the ink supplying and collection for the other nozzles N, performs the ink ejection from the other nozzles through the driving of the piezoelectric elements 44. Accordingly, in the following explanation, an explanation will be given of the ejection control procedure in anticipation of a transition to the ejection fault from a state in which there is no fault in the ink ejection in the nozzle N which serves as the execution target of the ejection control. The nozzle N which serves as the execution target of the ejection control will be referred to as the control-target nozzle N.

If there is no ejection fault in the control-target nozzle N, the control unit 200 determines that recovery waiting is not underway in the determination of recovery waiting of the ejection faults of step S200 and proceeds to the voltage application of the following step S210. The voltage application of step S210 is performed using the voltage application data, in which the print data is converted by the data conversion output unit 210 for the ink ejection from the control-target nozzle N, as a drive signal. Specifically, at the execution time of step S210, if the control-target nozzle N is a nozzle N for which ink ejection is unnecessary, since the data conversion output unit 210 sets the voltage application data of the piezoelectric element 44 to null data for which driving is unnecessary, the ink ejection does not occur in the control-target nozzle N in step S210. Meanwhile, if the control-target nozzle N is a nozzle N for which the ink ejection is necessary, since the data conversion output unit 210 sets the voltage application data of the piezoelectric element 44 to a drive signal in which the driving is necessary, the voltage application is performed on the piezoelectric element 44 of the control-target nozzle N in step S210 and the ink ejection from the control-target nozzle N is performed.

Continuing from the ink ejection of the control-target nozzle N, the control unit 200 causes the switching signal to be output from the switching signal output unit 215 to the switcher 150 and switches the switcher 150 from the application position Vp to the vibration detection position Sp (step S220). Due to the switching, since the increasing or decreasing change in the electrostatic capacity which corresponds to the flexural vibration of the piezoelectric element 44 is input to the vibration generating circuit 310 from the second electrode 442, the control unit 200 detects the vibration transition of the residual vibration which occurs in the ink of the pressure chamber C corresponding to the control-target nozzle N using the pressure change accompanying the driving of the piezoelectric element 44 in step S210 (step S230). In the transition detection of the residual vibration, a residual vibration waveform corresponding to the increasing or the decreasing change in the electrostatic capacity which is obtained by receiving an input from the second electrode 442 is obtained by the vibration generating circuit 310 as a vibration waveform and the vibration waveform is subjected to voltage-frequency conversion by the voltage-frequency conversion circuit 320. Subsequently, the conversion of the vibration waveform (the residual vibration waveform) which undergoes the voltage-frequency conversion of the voltage-frequency conversion circuit 320 to a square wave is performed.

Continuing from the transition detection of the residual vibration of step S230, the control unit 200 receives the square wave which is converted by the voltage-frequency conversion circuit 320 using the ejection fault determination unit 220 after the square wave undergoes waveform shaping in the waveform shaping circuit 330 and performs square wave frequency measurement which serves as waveform measurement using the ejection fault determination unit 220 (step S240). As already described, the ink ejection faults of the nozzles N occur due to nozzle blockage and the like caused by bubbles and foreign matter remaining in the pressure chambers C or by foreign matter such as paper fragments, and the liquid ejecting apparatus 100 of the present embodiment stores the transition, the period, the frequency, the attenuation ratio, and the like of the residual vibration waveforms in the pressure chambers C in these situations in memory. Accordingly, in the ejection fault determination of step S250 which continues from step S240, the control unit 200 contrasts the period of the already stored residual vibration with the period of the residual vibration waveform which is measured at the present time in step S240 and determines whether or not an ejection fault of the ink is occurring in the control-target nozzle N from the contrasting results (step S260). An ejection fault determination in step S260 has the same meaning as determining that the vibration transition which is detected in step S230 is the ejection fault vibration transition corresponding to a fault in the liquid ejection from the control-target nozzle N. Accordingly, the ejection control including the determination of the ejection faults of steps S250 to S260 and the control unit 200 which executes the ejection control configure the ejection fault determination unit in the invention together with the residual vibration detection device 300.

At the current time, since the ejection fault does not occur in the control-target nozzle N, the control unit 200 determines that there is no ejection fault in step S260, and in the following step S270, the control unit 200 switches the switcher 150 from the vibration detection position Sp to the application position Vp. Accordingly, there are no impediments to the voltage application of the piezoelectric element 44 at the next ink ejection timing.

Continuing from the switch to the application position Vp, the control unit 200 determines whether or not printing, which is suitable for the series of printing requests which are obtained by receiving a transmission from the print data transmitting device GM, is completed (step S280). When the control unit 200 determines that the printing is completed, the control unit 200 ends the ejection control routine, and if the printing is incomplete, the control unit 200 transitions to step S200 and repeats the processes that are already described. Accordingly, in a situation in which the control unit 200 determines that the control-target nozzle N has an ejection fault in step S260, the detection of an ejection fault is performed for every ink ejection timing according to a drive signal which defines whether or not the ink ejection is present in the control-target nozzle N. In other words, the detection of the vibration transition of the residual vibration which occurs in the ink in the pressure chamber C of the control-target nozzle N caused by a pressure change which accompanies the driving of the piezoelectric element 44 for the ink ejection is executed using the duration of the consecutive ink ejection timings according to the drive signals as a detection period.

Meanwhile, when the control unit 200 determines that there is a fault in the ink ejection in the control-target nozzle N caused by remaining bubbles or the like in the pressure chamber C in step S260, the control unit 200 temporarily stops the ink ejection from the control-target nozzle N (step S290). In step S260, the pressure chamber C of the control-target nozzle N which is determined to have an ink ejection fault is an ejection fault pressure chamber in the invention. In step S260, the control-target nozzle N which is determined to have an ink ejection fault is a nozzle N corresponding to the ejection fault pressure chamber in the invention. The process of step S290 of temporarily stopping the ink ejection from the control-target nozzle N has the same meaning as stopping the driving of the piezoelectric element 44 of the control-target nozzle N spanning at least a fixed stopping period regardless of the series of printing requests. In other words, a situation in which the driving of the piezoelectric element 44 of the control-target nozzle N is stopped by the process of step S290 is the driving stopping time of the piezoelectric element 44. The temporary stopping of the ink ejection from the control-target nozzle N is performed together with the driving stopping of the piezoelectric element 44 for the pressure chamber C of the control-target nozzle N. The control unit 200 temporarily stops the ink ejection in step S290 spanning a fixed stopping period of approximately 1 to 30 seconds, for example. Hereinafter, the fixed stopping period will be referred to as a temporary stopping period. When the control unit 200 determines that there is an ejection fault in step S260, the control unit 200 stores the origin, specifically, one of the remaining of bubbles in the pressure chamber C, the remaining of foreign matter in the pressure chamber C, and the blockage of the nozzle by foreign matter such as paper fragments in the ejection fault memory unit 230 together with nozzle data with which it is possible to specify the control-target nozzle N which causes the ejection fault. The stored result may be used when performing the recovery process on the control-target nozzle N which causes the ejection fault.

Continuing from the temporary stopping of the ink ejection, the control unit 200 performs notification of the fact that an ejection fault occurs in the control-target nozzle N (step S292). The control unit 200 displays text such as "ink ejection fault occurred", an image which causes recognition of the ejection fault, or the like on the display device GD, performs blinking control of a warning lamp (not illustrated) which is included in the liquid ejecting apparatus 100, or the like to perform notification of the fact that an ejection fault occurs in the control-target nozzle N.

Once the control unit 200 performs the notification of the ejection fault, the control unit 200 transitions to step S270 and switches the switcher 150 from the vibration detection position Sp to the application position Vp. Accordingly, there are no impediments to the voltage application of the piezoelectric element 44 at the ink ejection timing after the recovery waiting of the ejection fault.

After temporarily stopping the ink ejection from the control-target nozzle N due to an ink ejection fault, the control unit 200 performs print completion determination in step S280 after transitioning to step S270 and subsequently transitions to step S200. In step S200 which is transitioned to in this manner, a negative determination is performed continually spanning the temporary stopping period from the temporary stopping of the ejection of the control-target nozzle N in step S290 in the previous ejection control. Accordingly, although the driving of the piezoelectric element 44 is not performed in the temporary stopping period for the control-target nozzle N which is determined to have an ejection fault, according to the supplying control illustrated in FIG. 10, the ink supplying and collection is performed intermittently in the pressure chamber C corresponding to the control-target nozzle N. Accordingly, the bubbles and foreign matter caused by the ink which passes through the pressure chamber C corresponding to the control-target nozzle N in the temporary stopping period are expected to be taken out and a recovery from the ejection fault is also expected.

Meanwhile, when the temporary stopping period elapses, in step S200, since it is determined that the recovery waiting of the ejection fault is completed, after the elapsing of the temporary stopping period, the processes of step S210 onward are repeated and the ink ejection from the control-target nozzle N is restarted.

The liquid ejecting apparatus 100 of the first embodiment which is described hereinabove continues the supplying of the ink to the pressure chambers C of each of the plurality of nozzles N and the collection of the ink which passes through each of the pressure chambers C using the supplying control illustrated in FIG. 10. The liquid ejecting apparatus 100 of the first embodiment ejects the ink from the nozzles N using pressure changes in the ink in the pressure chambers C caused by the piezoelectric element 44 in each of the pressure chambers C in a situation in which the supplying and collection of the ink to the pressure chamber C of each of the plurality of nozzles N are continued. Upon ejecting the ink, when there is a fault in the ink ejection in the ink ejecting situation (step S260), the liquid ejecting apparatus 100 of the first embodiment stops the ink ejection from the control-target nozzle N in which the ejection fault occurs spanning a temporary stopping period (step S290), and after the temporary stopping period elapses, restarts the ink ejection from the control-target nozzle N which is determined to have the ejection fault. Since the supplying and collection of the ink to the pressure chamber C for the control-target nozzle N which is determined to have an ejection fault is continued even in the temporary stopping period, the bubbles and foreign matter which enter the pressure chamber C may be taken out by the ink passing through the pressure chamber C in the temporary stopping period. Accordingly, it is possible that the ejection fault will disappear after the passage of the temporary stopping period. Additionally, the ink ejection stopping target is the control-target nozzle N which is determined to have an ejection fault, and in the other nozzles N, the ink ejection is continued even in the temporary stopping period due to the driving of the piezoelectric elements 44 corresponding to the series of printing requests. Accordingly, according to the liquid ejecting apparatus 100 of the first embodiment, in addition to being capable of handling the bubbles and foreign matter even in inter-reservoir circulation in the Y direction or the like is not performed, it is possible to perform the removal of the bubbles and foreign matter and the erasure of the bubbles from the control-target nozzle even during the ink ejection of the nozzles other than the control-target nozzle.

The liquid ejecting apparatus 100 of the first embodiment is provided with the first recovery mechanism 110 which performs the wiping and the second recovery mechanism 120 which is capable of popping or flushing to achieve a recovery from ink ejection faults. Accordingly, in the course of repeating the ejection control illustrated in FIG. 11, in a case in which ejection faults occur in a plurality of the nozzles N or in which an ejection fault occurs repeatedly in a certain specific nozzle N, it is possible to reliably recover from the ejection faults through wiping by the first recovery mechanism 110 and the popping and the flushing which use the second recovery mechanism 120. In the present embodiment, since the control-target nozzle N which causes the ejection fault is stored in association with the fault origin as described earlier, during the flushing which uses the second recovery mechanism 120, it is possible to achieve fault recovery by ejecting (flushing) a greater amount of the ink from the control-target nozzle N than the ink ejection amount during the printing for only the control-target nozzle N which causes the ejection fault. If the second recovery mechanism 120 is configured to enable the popping of individual nozzles N, even if the popping uses the second recovery mechanism 120, it is possible to perform suction (the popping) for only the control-target nozzle N which causes the ejection fault to achieve the fault recovery.

When the liquid ejecting apparatus 100 of the first embodiment temporarily stops the ink ejection from the control-target nozzle N, the liquid ejecting apparatus 100 notifies the user of the fact that an ejection fault occurs in the control-target nozzle N using text display on the display device GD or the like. Therefore, according to the liquid ejecting apparatus 100 of the first embodiment, it is possible to cause the user to recognize the fact that there is a possibility of the occurrence of a reduction in the quality of the printed image or the like which may be obtained on the medium 12 using the ink ejection from the liquid ejecting head 26.

The liquid ejecting apparatus 100 of the first embodiment drives the piezoelectric elements 44 of the pressure chambers C while causing the liquid ejecting head 26 to scan in the main scanning direction with respect to the medium 12 and causes the acceleration which accompanies the scanning of the liquid ejecting head 26 in the main scanning direction to influence the pressure chamber C corresponding to the control-target nozzle N which causes an ejection fault. Therefore, according to the liquid ejecting apparatus 100 of the first embodiment, since it is possible to cause the bubbles and the foreign matter which are mixed into the ink of the pressure chamber C corresponding to the control-target nozzle N which causes the ejection fault to move to the discharge liquid chamber 65 side using the acceleration during the scanning, it is possible to expect an early recovery of the control-target nozzle N which is an ejection fault nozzle.

B. Second Embodiment

Figure 12:
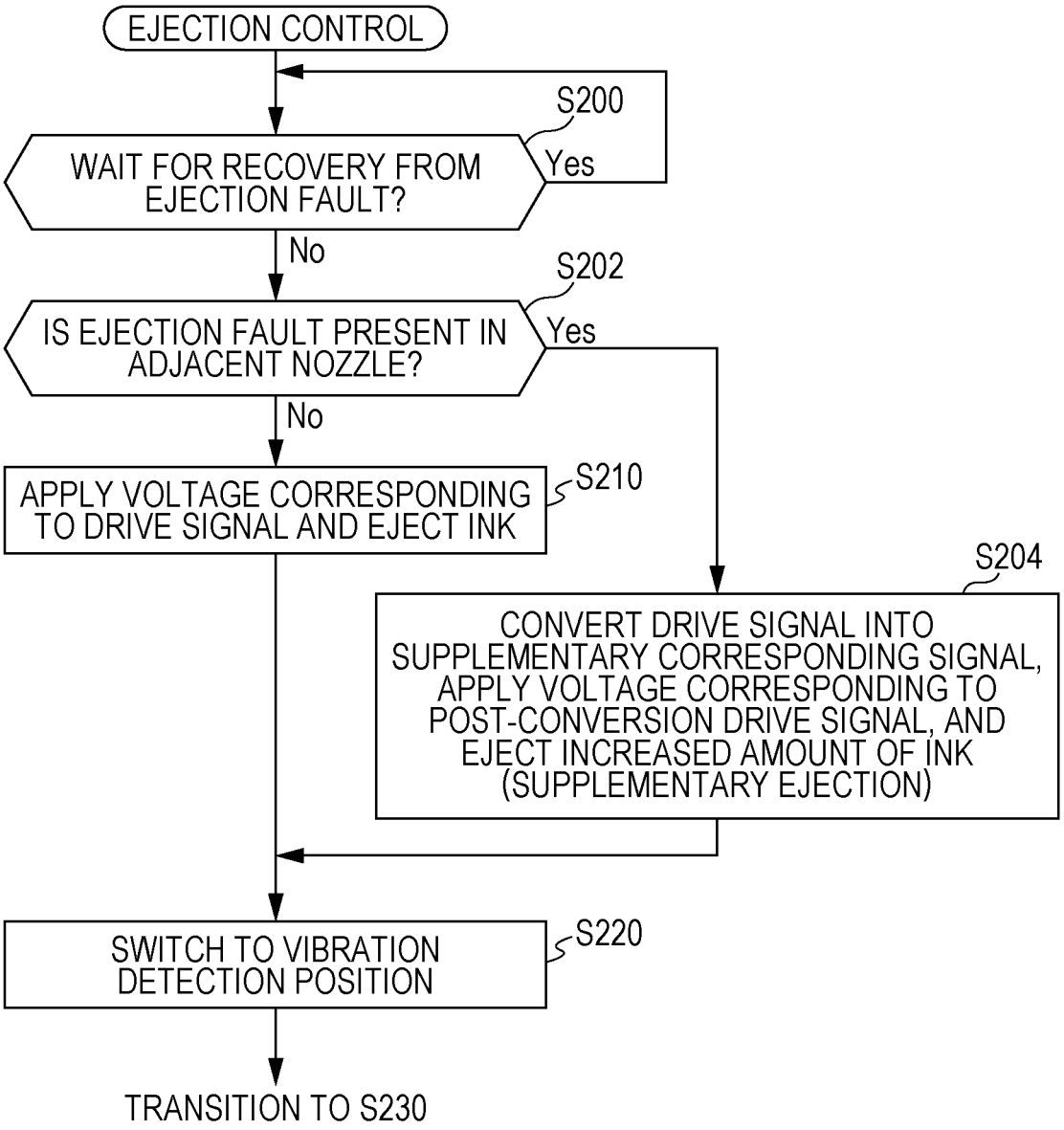
FIG. 12 is a flowchart illustrating a procedure of ejection control in a liquid ejecting apparatus of a second embodiment.

FIG. 12 is a flowchart illustrating a procedure of ejection control in a liquid ejecting apparatus of a second embodiment. In the same manner as the liquid ejecting apparatus 100 of the first embodiment, even the ejection control of the liquid ejecting apparatus of the second embodiment is individually executed for each of the individual piezoelectric elements 44 using the piezoelectric elements 44 in each of the pressure chambers C of the first nozzle row L1 and the second nozzle row L2 as control targets in a printing situation.

In the ejection control of the liquid ejecting apparatus of the second embodiment, in the same manner as the liquid ejecting apparatus 100 of the first embodiment, the control unit 200 performs determination of whether the situation is a recovery waiting situation from an ejection fault which accompanies a temporary stopping of the ink ejection (step S200) and waits for the recovery from the ejection fault. Next, in the ejection control of the liquid ejecting apparatus of the second embodiment, the control unit 200 determines whether or not the nozzle N which is adjacent to the control-target nozzle N at the current time, for example, if the control-target nozzle N is a nozzle N belonging to the first nozzle row L1, the nozzle N which belongs to the second nozzle row L2 and is the nozzle N which is adjacent to the control-target nozzle N in the main scanning direction, is determined to have an ejection fault in the ejection control until the current time (step S202). The pressure chamber C of the adjacent nozzle N corresponds to an adjacent pressure chamber in the invention. If the control unit 200 determines that an ejection fault does not occur in the adjacent nozzle N, the control unit 200 transitions to step S210 which is already described and applies a voltage corresponding to the drive signal which matches the control-target nozzle N to the piezoelectric element 44 of the control-target nozzle N. Subsequently, the control unit 200 executes the processes of step S220 onward which are already described.

Meanwhile, in step S202, when the control unit 200 determines that there is an ejection fault in the adjacent nozzle N, the control unit 200 converts the drive signal which is originally associated with the control-target nozzle N into a supplementary corresponding signal which supplements the drive signal such that the vibration of the piezoelectric element 44 is increased in size (step S204). Accordingly, a voltage, which is supplemented such that a greater amount of the ink ejection occurs than the ejection droplet amount of the ink originally to be ejected using the supplementary corresponding signal, is applied to the piezoelectric element 44 of the control-target nozzle N. As a result, the ink ejection from the control-target nozzle N is increased in size and performed to supplement the adjacent nozzle N for which the ink ejection is temporarily being stopped due to an ejection fault. Continuing from step S204, the control unit 200 executes the processes of step S220 onward which are already described. In the ejection fault determination in step S250 after undergoing step S204, since the residual vibration, the amplitude, and the frequency are different due to the pressure change being large in the piezoelectric element 44 which brings about the increased-amount ejection in step S204, this point is taken into consideration. Specifically, a configuration may be adopted in which the residual vibration transition of a case in which the supplementary ejection is performed in advance is anticipated and stored as described earlier, the residual vibration transition after undergoing step S204 is contrasted with the stored result, and the presence or absence of an ejection fault is determined.

The ejection control of the second embodiment is repeated until the printing completion in the same manner as in the first embodiment. Accordingly, the supplementary ejection of the control-target nozzle N is continued during the period until the ejection fault in the adjacent nozzle N is recovered from and the driving of the piezoelectric element 44 of the adjacent nozzle N is restarted to receive the original voltage application.

In the liquid ejecting apparatus of the second embodiment described above, even if an ink ejection fault occurs in a nozzle N belonging to one row of the first nozzle row L1 and the second nozzle row L2, an amount of ink corresponding to that which could not be ejected from the nozzle N having the ejection fault is supplemented and ejected from the nozzle N which is adjacent to the nozzle N having the ejection fault in the main scanning direction. Therefore, according to the liquid ejecting apparatus of the second embodiment, it is possible to suppress a quality reduction in the printed item such as a printed image which is printed on the medium 12.

C. Third Embodiment

Figure 13:
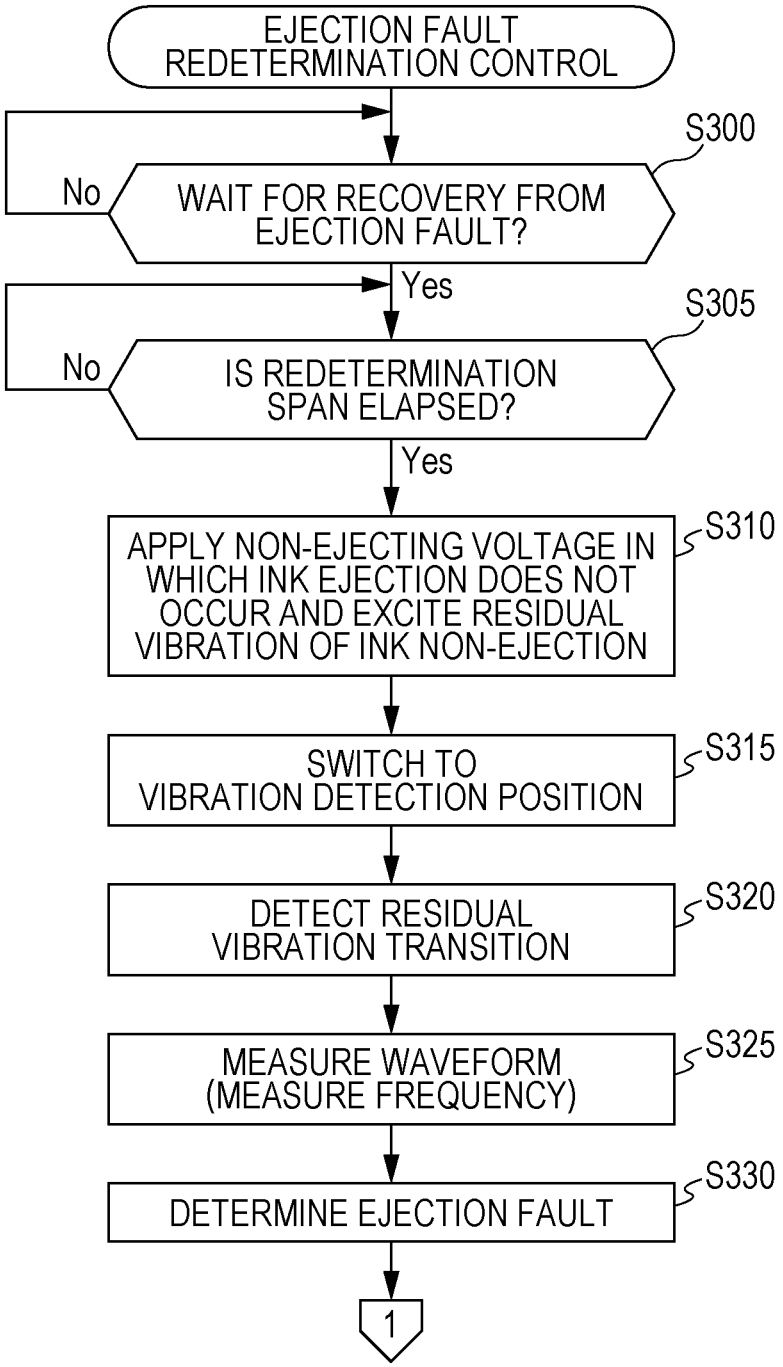
FIG. 13 is a flowchart illustrating a procedure of a prior half of redetermination control of an ejection fault in a liquid ejecting apparatus of a third embodiment.
Figure 14:
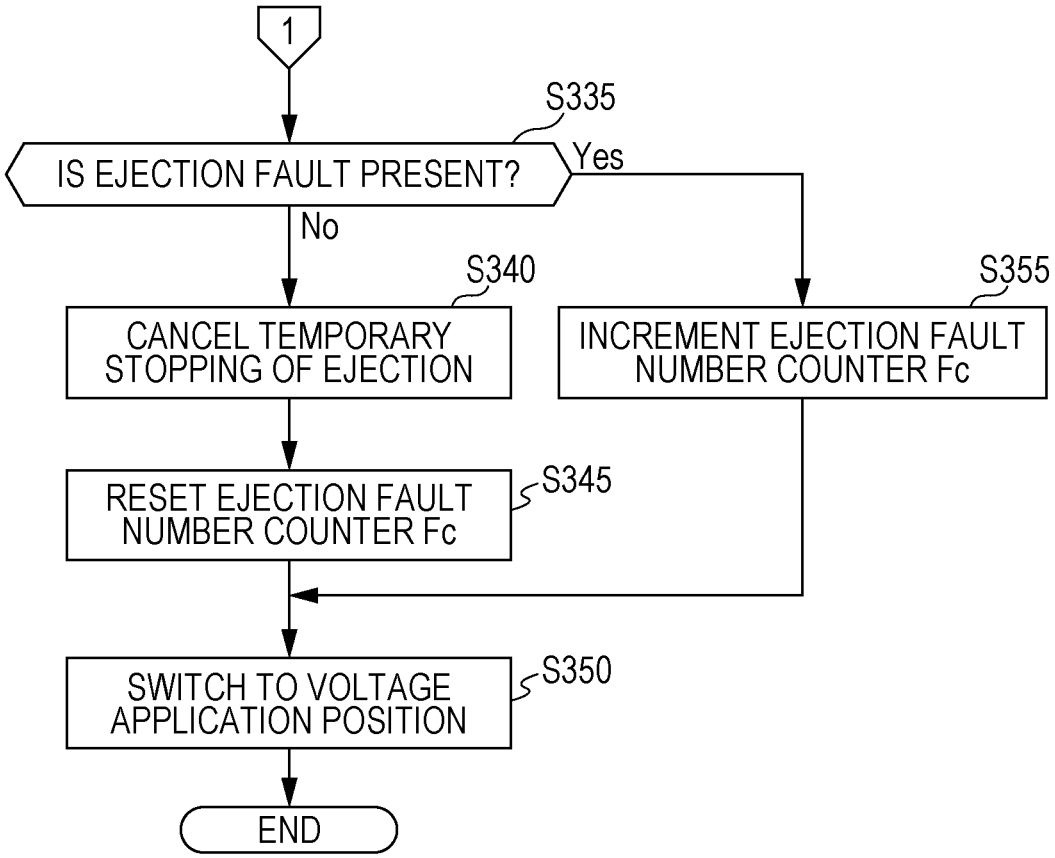
FIG. 14 is a flowchart illustrating a procedure of a latter half of the redetermination control of an ejection fault in the liquid ejecting apparatus of the third embodiment.

FIG. 13 is a flowchart illustrating a procedure of a prior half of redetermination control of an ejection fault in a liquid ejecting apparatus of a third embodiment. FIG. 14 is a flowchart illustrating a procedure of a latter half of the redetermination control of an ejection fault in the liquid ejecting apparatus of the third embodiment. The redetermination control is executed by the control unit 200 together with the switching of the switcher 150 by the switching signal output unit 215, the ejection fault determination by the ejection fault determination unit 220, and the waveform shaping by the residual vibration detection device 300 in the period in which an ejection fault occurs in the control-target nozzle N in the ejection control and the ink ejection from the nozzle is temporarily stopped. Furthermore, the redetermination control is executed using the piezoelectric element 44 in the pressure chamber C of the control-target nozzle N in which it is determined that an ejection fault occurs in the ejection control as a control target. Accordingly, in the following explanation, the control-target nozzle in the redetermination control will be referred to as the redetermination-target nozzle N. Even before the starting of the redetermination control, according to step S270 in the executed ejection control, the switcher 150 is switched by the switching signal output unit 215 to the application position at which the voltages are applied to the piezoelectric elements 44 in the pressure chambers C.

First, the control unit 200 determines whether the situation is a recovery waiting situation of ejection faults accompanying a temporary stopping of the ink ejection according to step S290 in the executed ejection control (step S300) and no processes are performed if the situation is not the recovery waiting situation. If there is no ejection fault in the executed ejection control, the liquid ejecting apparatus 100 is not in the state of recovery waiting from an ejection fault. Accordingly, the redetermination control is first executed when it is determined that there is an ejection fault in the executed ejection control and the ejection is temporarily stopped.

In step S300, when the control unit 200 determines that the situation is the recovery waiting situation from an ejection fault, the control unit 200 determines whether or not a redetermination span is elapsed (step S305) and waits until the redetermination span is elapsed. The redetermination span defines the interval when repeatedly executing the various types of redetermination processes of the redetermination control in a situation in which it is determined that there is an ejection fault in the executed ejection control. In the present embodiment, the redetermination span is set to 1 to 40 seconds. The redetermination span is longer than a fault determination span in the ejection fault determination in the ejection control, that is, longer than the detection span (the detection period) of the ejection fault between consecutive ink ejection timings according to the drive signals.

When the redetermination span passes, the control unit 200 applies the non-ejecting voltage in which the ink ejection does not occur to the piezoelectric element 44 of the pressure chamber C of the redetermination-target nozzle N (step S310). Due to the application of the non-ejecting voltage, in the pressure chamber C of the redetermination-target nozzle N, a pressure change, which does not cause the ink ejection from the redetermination-target nozzle N, occurs.

Continuing from the application of the non-ejecting voltage to the piezoelectric element 44 in the pressure chamber C of the redetermination-target nozzle N, the control unit 200 causes a switching signal to be output from the switching signal output unit 215 to the switcher 150 and switches the switcher 150 from the application position Vp to the vibration detection position Sp (step S315). Due to the switching, since the increasing or decreasing change in the electrostatic capacity which corresponds to the flexural vibration of the piezoelectric element 44 based on the application of the non-ejecting voltage is input to the vibration generating circuit 310 from the second electrode 442, the control unit 200 detects the vibration transition of the residual vibration which occurs in the ink of the pressure chamber C corresponding to the redetermination-target nozzle N using the pressure change accompanying the driving of the piezoelectric element 44 in step S310 (step S320). In the transition detection of the residual vibration, a residual vibration waveform corresponding to the increasing or the decreasing change in the electrostatic capacity which is obtained by receiving an input from the second electrode 442 is obtained by the vibration generating circuit 310 as a vibration waveform and the vibration waveform is subjected to voltage-frequency conversion by the voltage-frequency conversion circuit 320. Subsequently, the conversion of the vibration waveform (the residual vibration waveform)

which undergoes the voltage-frequency conversion of the voltage-frequency conversion circuit 320 to a square wave is performed.

Continuing from the transition detection of the residual vibration of step S320, the control unit 200 receives the square wave which is converted by the voltage-frequency conversion circuit 320 using the ejection fault determination unit 220 after the square wave undergoes waveform shaping in the waveform shaping circuit 330 and performs square wave frequency measurement which serves as waveform measurement using the ejection fault determination unit 220 (step S325). Although the voltage application in step S310 is an application at a non-ejecting voltage which does not cause the ink ejection, the voltage application brings about a residual vibration which is different in amplitude and period from the voltage application when the ink ejection is caused. Even if the residual vibration is caused by the application of the non-ejecting voltage, the residual vibration receives the influence of bubbles or foreign matter which remain in the pressure chamber C or by nozzle blockage or the like which is caused by foreign matter such as paper fragments and transitions. Accordingly, in the present embodiment, the transition and the period of the residual vibration waveform which occurs in the ink of the pressure chamber C in the non-ejecting voltage application which does not cause the ink ejection are stored in memory in advance in association with the ejection fault origin. In the ejection fault determination of step S330 which continues from step S325, the control unit 200 contrasts the period of the already stored residual vibration with the period of the residual vibration waveform which is based on the non-ejecting voltage application which is measured in step S325 and determines (redetermined) whether or not an ejection fault of the ink is occurring in the redetermination-target nozzle N from the contrasting results (step S335). The redetermination control including step S335 is executed after determining that an ejection fault occurs using the previous ejection control as described earlier. Accordingly, the ejection fault determination in step S335 determines whether the fault in the ink ejection in the pressure chamber C of the redetermination-target nozzle N continues to be present or the ejection fault is recovered from.

When the control unit 200 determines that there is no ejection fault in the redetermination-target nozzle N after undergoing the detection of the residual vibration transition based on the non-ejecting voltage application (step S320), that is, that the ejection fault is recovered from using step S335, the control unit 200 cancels the temporary stopping of the ejection which is performed in the ejection control (step S340). Accordingly, the ink ejection is restarted from the control-target nozzle N at the timing of the ink ejection at the current time onward. The redetermination control which performs the temporary stopping cancellation of the ejection according to step S340, is performed during the period in which the ink ejection from the control-target nozzle N which is determined to have generated an ejection fault is temporarily stopped. Accordingly, due to the cancellation of the temporary stopping of the ejection according to step S340, the driving of the piezoelectric element 44 of the pressure chamber C for the control-target nozzle N is restarted regardless of the passage of the temporary stopping period which is defined in advance.

Continuing from the cancellation of the temporary stopping of the ejection, the control unit 200 resets an ejection fault number counter Fc which represents the number of times the control unit 200 redetermines that an ejection fault is present in the present redetermination control (step S345). Subsequently, in the same manner as the ejection control, the control unit 200 switches the switcher 150 from the vibration detection position Sp to the application position Vp (step S350) and temporarily ends the redetermination control. Accordingly, there are no impediments to the voltage application of the piezoelectric element 44 at the ink ejection timing from when the temporary stopping of the ejection is canceled in step S340 onward.

Meanwhile, when the control unit 200 determines that the ejection fault continues in the pressure chamber C of the redetermination-target nozzle N in step S335, the control unit 200 increments the ejection fault number counter Fc by a value of 1 (step S355), transitions to the switching of step S350, and subsequently temporarily ends the redetermination control. The ejection fault number counter Fc is incremented every time the continuation determination of the ejection fault is performed in step S335 until either the resetting in step S345 after undergoing the recovery determination of the ejection fault in step S335 or the resetting in the recovery control (described later) is performed. In other words, it becomes clear as to how many times the continuation of the ejection fault is consecutively determined in the repeating of the redetermination control for every redetermination span using the counter value of the ejection fault number counter Fc.

When the control unit 200 determines that the ejection fault is continued in step S335, in the same manner as in the case of the ejection control, the control unit 200 the origin of the ejection fault in the ejection fault memory unit 230 together with nozzle data capable of specifying the redetermination-target nozzle N which is determined to have a continuing ejection fault. The stored result becomes usable when performing the recovery process on the redetermination-target nozzle N for which it is redetermined that the ejection fault is continuing.

Figure 15:
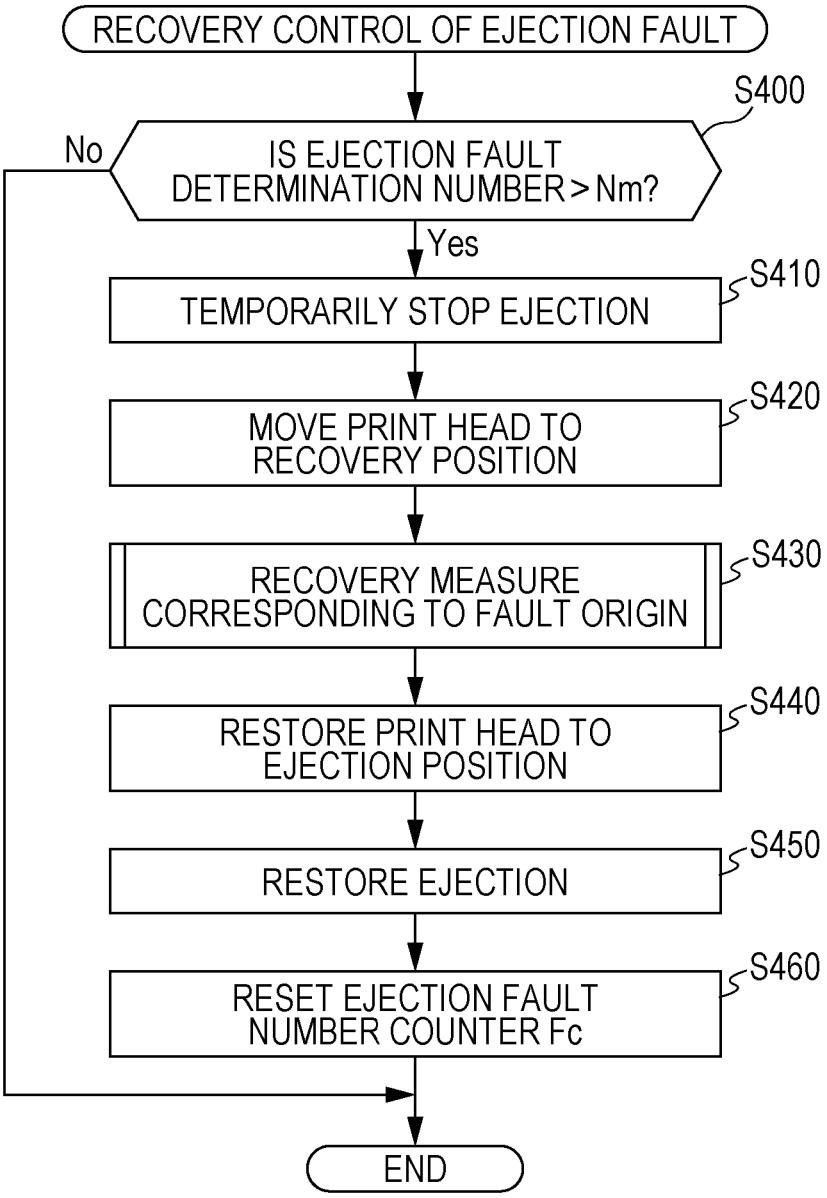
FIG. 15 is a flowchart illustrating a procedure of recovery control from the ejection faults in the liquid ejecting apparatus of the third embodiment.

FIG. 15 is a flowchart illustrating a procedure of recovery control from the ejection faults in the liquid ejecting apparatus of the third embodiment. The recovery control is executed while keeping the execution timing of the redetermination control while the redetermination control is being performed. First, the control unit 200 determines whether or not the number of times it is determined that an ejection fault is consecutively present in the redetermination control, that is, whether or not the ejection fault determination number reaches a predetermined fault determination number Nm (step S400). The determination is performed by comparing the ejection fault number counter Fc which represents the ejection fault determination number with the fault determination number Nm. In the present embodiment, the fault determination number Nm is set to be smaller the greater the passage amount of the ink which passes through the pressure chamber C, or alternatively, the higher the ink temperature (the liquid temperature). For example, since the pumping pressure of the pump 15 is proportional to the ink passage amount of the pressure chamber C, the control unit 200 senses the pump pumping pressure, and sets the fault determination number Nm to a small value if the ink passage amount is greater than a defined value. Alternatively, if the environmental temperature which is detected by a temperature sensor is higher than the defined temperature, the control unit 200 sets the fault determination number Nm to a low value with the premise that the ink temperature is also higher than the defined temperature.

If the control unit 200 determines that the ejection fault determination number does not reach the predetermined fault determination number Nm in step S400, the control unit 200 ends the present recovery control without performing the processes thereafter. Meanwhile, if the control unit 200 determines that the ejection fault determination number reaches the predetermined fault determination number Nm in step S400, the control unit 200 temporarily stops the ink ejection from all of the nozzles N of the first nozzle row L1 and the second nozzle row L2 (step S410). The ink ejection is not performed until the ejection is restored after undergoing the recovery process from the ejection fault (described later) according to the temporary stopping of the ejection. In other words, the data conversion output unit 210 stops the outputting of the drive signals corresponding to the print data to each of the nozzles N at the time at which the temporary stopping of the ejection is performed in step S410.

Continuing from the cancellation of the temporary stopping of the ejection, upon storing the stopping position of the liquid ejecting head 26 in the main scanning direction at the current time, the control unit 200 causes the liquid ejecting head 26 to move to a recovery position (step S420). At this time, since the fault origin for the nozzle N which causes the ejection fault is already stored, the control unit 200 reads the stored result, specifically, one of the ejection fault caused by remaining bubbles in the pressure chamber C, the ejection fault caused by foreign matter in the pressure chamber C, or the ejection fault caused by blockage by foreign matter of the nozzle N. The control unit 200 causes the liquid ejecting head 26 to move to the recovery position corresponding to the origin of the ejection fault.

If the ejection fault is the ejection fault caused by the remaining bubbled in the pressure chamber C or the ejection fault caused by the foreign matter in the pressure chamber C, the control unit 200 causes the liquid ejecting head 26 to move to the recovery position of the second recovery mechanism 120 as illustrated in FIG. 9. If the ejection fault is the ejection fault caused by the blockage of the nozzle N by the foreign matter, the control unit 200 causes the liquid ejecting head 26 to move to the recovery position of the first recovery mechanism 110 as illustrated in FIG. 8.

Continuing from the movement of the liquid ejecting head 26 to the recovery position, the control unit 200 performs the recovery measure corresponding to the ejection fault (step S430). Specifically, if the ejection fault is the ejection fault caused by bubbles remaining in the pressure chamber C or the ejection fault caused by foreign matter in the pressure chamber C, popping or flushing is executed in order to achieve the carrying out of the remaining bubbles or foreign matter using the ink which flows from the pressure chamber C to the discharge liquid chamber 65.

In a case in which the popping is performed, upon pressing the second recovery mechanism 120 against the nozzle plate 52 of the liquid ejecting head 26 in an airtight manner, the inside of the container of the opening container 121 is suctioned while achieving the ink supplying to the pressure chambers C of the liquid ejecting head 26. Due to the popping, the bubbles and foreign matter which cause the faults in the ink ejection by remaining in the pressure chambers C and the communicating paths 63 downstream thereof are taken out by the ink which flows in the pressure chambers C. In a case in which the flushing is performed, the piezoelectric elements 44 of the pressure chambers C are driven while achieving the ink supplying to the pressure chambers C of the liquid ejecting head 26 in a situation in which the opening container 121 is not suctioned such that a greater amount of the ink is ejected than the ink ejection amount during the printing. Due to the flushing, the bubbles and foreign matter which cause the faults in the ink ejection by remaining in the pressure chambers C and the communicating paths 63 downstream thereof are taken out by the ink which flows in the pressure chambers C. The flushing may be performed only on the nozzles N for which ejection faults occur.

In a case in which the wiping is performed, the first recovery mechanism 110 is raised and the wiping member 114 is caused to protrude from the nozzle plate 52 in the liquid ejecting head 26. In this state, the liquid ejecting head 26 is caused to move in the −X direction, is caused to move reciprocally along the X direction, or the like to execute the wiping using the wiping member 114 and the foreign matter such as the paper fragments which adhere to the bottom surface of the nozzle plate 52 and block openings of the nozzles N are removed.

Continuing from the recovery measure of the ejection fault, the control unit 200 causes the liquid ejecting head 26 to be restored to the ejecting position during the temporary stopping of the ejection from the recovery position (step S440) and subsequently cancels the temporary stopping of the ejection and restores the ejection (step S450). Together with the position restoration and the ejection restoration, the data conversion output unit 210 outputs the drive signals of the time at which the stopping is performed corresponding to the temporary stopping of the ejecting in step S410 onward to each of the nozzles N. Accordingly, the printing which is stopped together with the recovery from the ejection fault is restarted.

Continuing from the ejection restoration, the control unit 200 resets the ejection fault number counter Fc (step S460) and ends the recovery control.

For the control-target nozzle N in which it is determined that an ejection fault of the ink occurs, in the temporary stopping period of the ink ejection from the nozzle, the liquid ejecting apparatus of the third embodiment applies the non-ejecting voltage of a low voltage which does not cause the ink ejection to the piezoelectric element 44 (step S310) and repeats a redetermination of the ejection fault from the vibration transition of the residual vibration which occurs in the ink of the pressure chamber C based on the application of the non-ejecting voltage (steps S320 to S335). When the liquid ejecting apparatus of the third embodiment determines that there is no fault in the ink ejection from the control-target nozzle N in the redetermination (step S335), the liquid ejecting apparatus restarts the driving of the piezoelectric element 44 of the pressure chamber C for the control-target nozzle N regardless of the passage of the temporary stopping period of the ink ejection (step S340). Accordingly, according to the liquid ejecting apparatus of the third embodiment, it is possible to restart the ink ejection from the control-target nozzle N in which an ejection fault occurs at an early stage.

In the liquid ejecting apparatus of the third embodiment, the redetermination span is rendered longer than the detection span (the detection period) during consecutive ink ejection timings which are the fault determination span in the ejection fault determination in the ejection control when repeatedly performing the redetermination after undergoing the application of the non-ejecting voltage for the control-target nozzle N in which it is determined that the ejection fault of the ink occurs. Accordingly, according to the liquid ejecting apparatus of the third embodiment, it is possible to achieve the following effects. Since the pressure change during the redetermination is the application of the non-ejecting voltage, although the application does not cause the ink ejection from the redetermination-target nozzle N, the application may influence the flow of the ink which passes through the pressure chamber C for the redetermination-target nozzle N. However, by rendering the redetermination span which is the redetermination period longer than the detection span (the detection period) before performing the redetermination, it is possible to reduce the influence of the pressure change during the redetermination on the flow of the ink which passes through the pressure chamber C for the redetermination-target nozzle N. As a result, according to the liquid ejecting apparatus of the third embodiment, by ensuring that the taking out of bubbles and foreign matter using the ink which passes through the pressure chamber C for the redetermination-target nozzle N is not impeded, it is possible to recover from the ejection fault in the redetermination-target nozzle N which is the ejection fault nozzle at an early stage.

The liquid ejecting apparatus of the third embodiment is provided with the first recovery mechanism 110 and the second recovery mechanism 120 which achieve the recovery from ejection faults and the liquid ejecting apparatus repeats the redetermination of the ejection fault for the redetermination-target nozzle N in which it is determined that an ejection fault is present in the ejection control. When it is consecutively determined that there is a fault in the ink ejection in the redetermination-target nozzle N over the predetermined fault determination number Nm in the redetermination (step S400), upon temporarily stopping the ink ejection from the redetermination-target nozzle N (step S410), the first recovery mechanism 110 or the second recovery mechanism 120 is used to recover from the ejection fault of the ink from the redetermination-target nozzle N (step S430). Accordingly, according to the liquid ejecting apparatus of the third embodiment, it is possible to reliably restart the ink ejection from the redetermination-target nozzle N in which an ejection fault occurs.

In the liquid ejecting apparatus of the third embodiment, the fault determination number Nm which defines the timing at which to achieve the recovery from the ejection fault using the first recovery mechanism 110 or the second recovery mechanism 120 is set to be smaller the greater the passage amount of the ink which passes through the pressure chamber C, or alternatively, the higher the ink temperature. Accordingly, according to the liquid ejecting apparatus of the third embodiment, it is possible to achieve the following effects. The greater the passage amount of the ink which passes through the pressure chamber C, the higher the chance that the bubbles or foreign matter which enters the pressure chamber C will be taken away by the ink which passes through the pressure chamber C. Since the dissolving of the bubbles into the ink progresses more the higher the temperature of the ink which passes through the pressure chamber C, the chance of the bubbles which enter the pressure chamber C being taken away by the ink which passes through the pressure chamber C increases. As a result, according to the liquid ejecting apparatus of the third embodiment, even if the fault determination number Nm is reduced and the number of times the fault determination is performed is reduced, it is possible to secure the reliability of the taking out of the bubbles or foreign matter by the ink which passes through the pressure chamber C and the recovery from the ejection fault due to the taking away also progresses.

D. Fourth Embodiment

Figure 16:
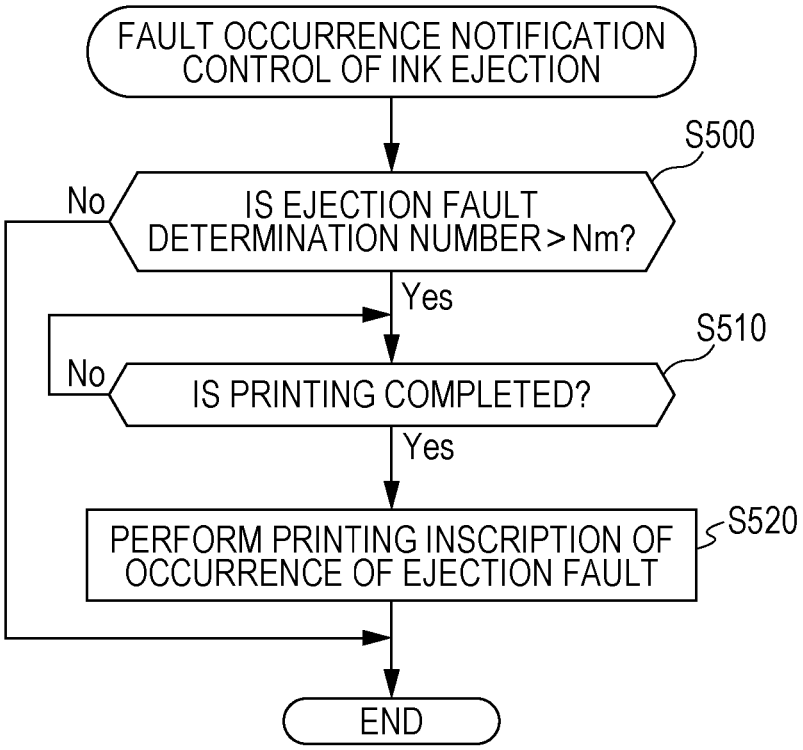
FIG. 16 is a flowchart illustrating a procedure of fault occurrence notification control of ink ejection in a liquid ejecting apparatus of a fourth embodiment.

FIG. 16 is a flowchart illustrating a procedure of fault occurrence notification control of the ink ejection in a liquid ejecting apparatus of a fourth embodiment. In the fault notification control, together with the completion of the printing, in order to inform the user of the fact that a fault is present in the ink ejection carried out until this point, first, the control unit 200 determines whether or not the ejection fault determination number reaches the predetermined fault determination number Nm in the same manner as the recovery control (step S500). If the control unit 200 determines that the ejection fault determination number does not reach the predetermined fault determination number Nm in step S500, the control unit 200 ends the present recovery control without performing the processes thereafter. Meanwhile, if the control unit 200 determines that the ejection fault determination number does not reach the predetermined fault determination number Nm in step S500, the control unit 200 determines whether or not all of the printing corresponding to the print data from the print data transmitting device GM is completed (step S510) and waits until the printing is completed.

Figure 17:
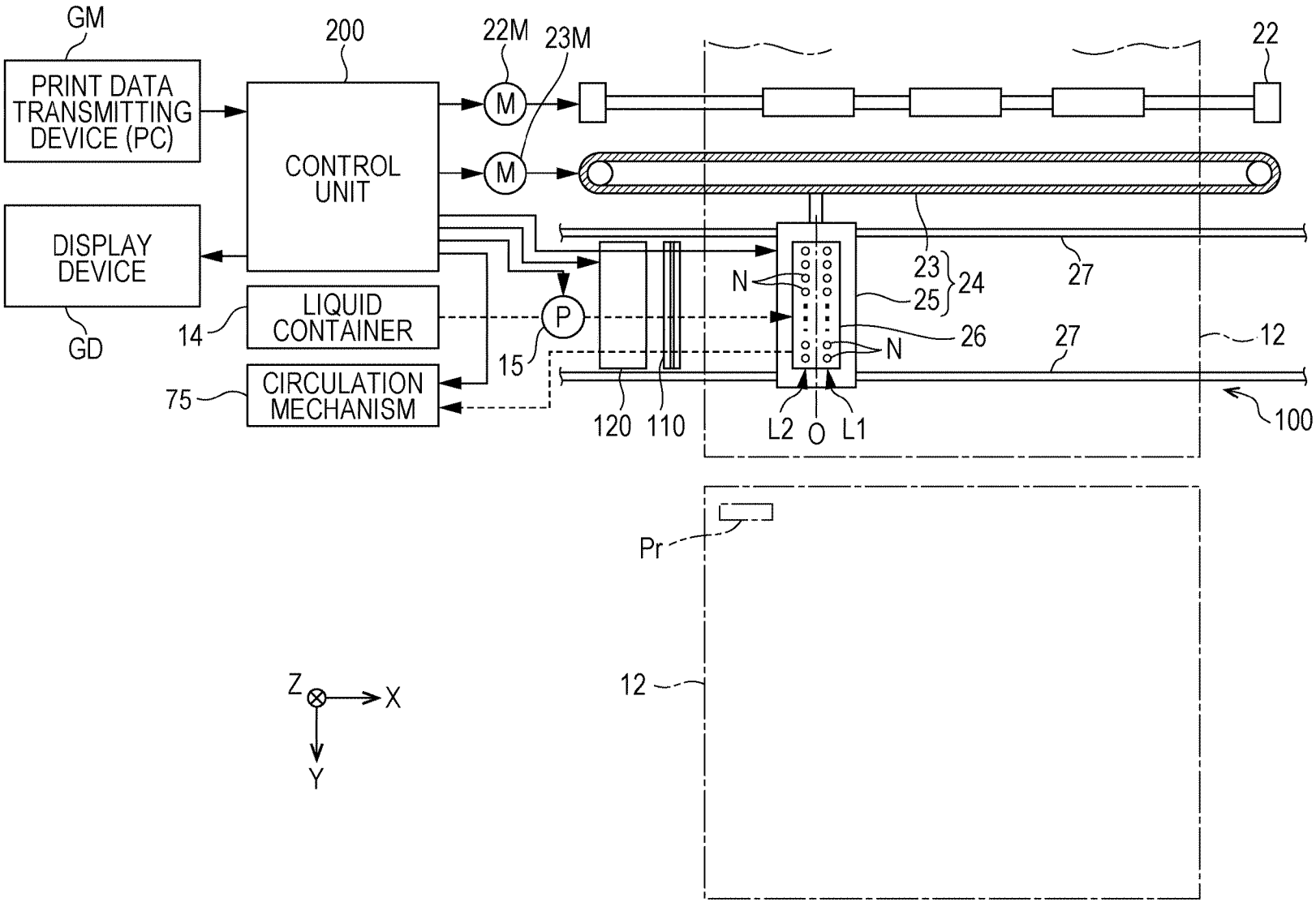
FIG. 17 is an explanatory diagram illustrating an example of notification of ink ejection.

When the printing is completed, in the course of the printing on a predetermined location of the medium 12 corresponding to the print data, the control unit 200 performs printing inscription of the fact that a fault is present in the ink ejection from the nozzle N (step S520), the control unit 200 ends the fault notification control. FIG. 17 is an explanatory diagram illustrating an example of notification of ink ejection. As illustrated, the liquid ejecting apparatus 100 prints, for example, text such as "there is a possibility that ink ejection faults occurred in the course of printing" or "ejection faults present", or a symbol which is associated in advance with the meaning that there is a possibility that ink ejection faults occurred in the course of printing on an inscription region Pr on a discharging rear end side of the medium 12 which is outside of the printing region of the printing image or the like based on the print data from the print data transmitting device GM. Since the printing is not included in the print data from the print data transmitting device GM, the drive signals necessary for the printing of the text or the symbol is output from the data conversion output unit 210 in step S520.

When the liquid ejecting apparatus of the fourth embodiment determines that an ejection fault of the ink occurs, the fault notification of this fact is performed using marking which undergoes the ink ejection from the nozzles N onto the medium 12 which is the ejection target of the ink as illustrated in FIG. 17. In the present embodiment, even if it is determined that an ejection fault of the ink occurs, since the supplying and collection of the ink to the pressure chamber C is continued, it is anticipated that the ejection fault is recovered from. However, notifying the user of the fact that the ejection fault occurs is beneficial. Therefore, according to the liquid ejecting apparatus of the fourth embodiment, it is possible to cause the user of the liquid ejecting apparatus to easily recognize the fact that there is a possibility of the occurrence of a reduction in the quality of the ejection product such as the printed image which may be obtained on the medium 12 which is the ejection target of the ink ejection from the nozzles N.

E. Fifth Embodiment

Figure 18:
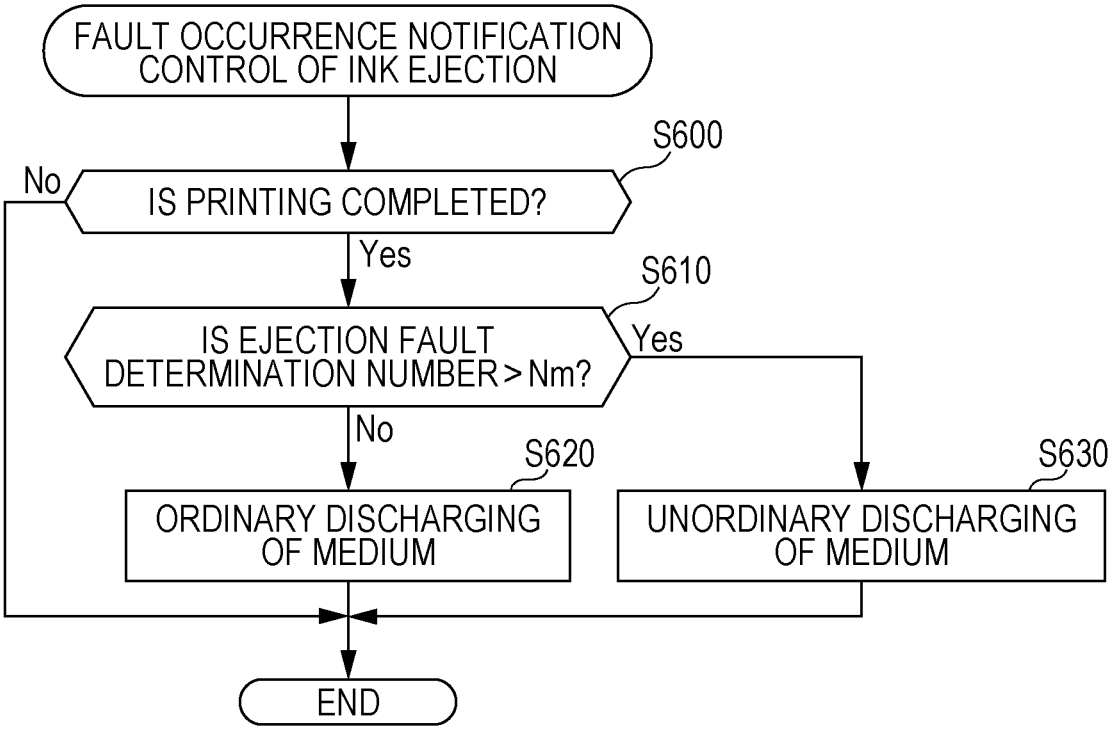
FIG. 18 is a flowchart illustrating a procedure of fault occurrence notification control of ink ejection in a liquid ejecting apparatus of a fifth embodiment.
Figure 19:
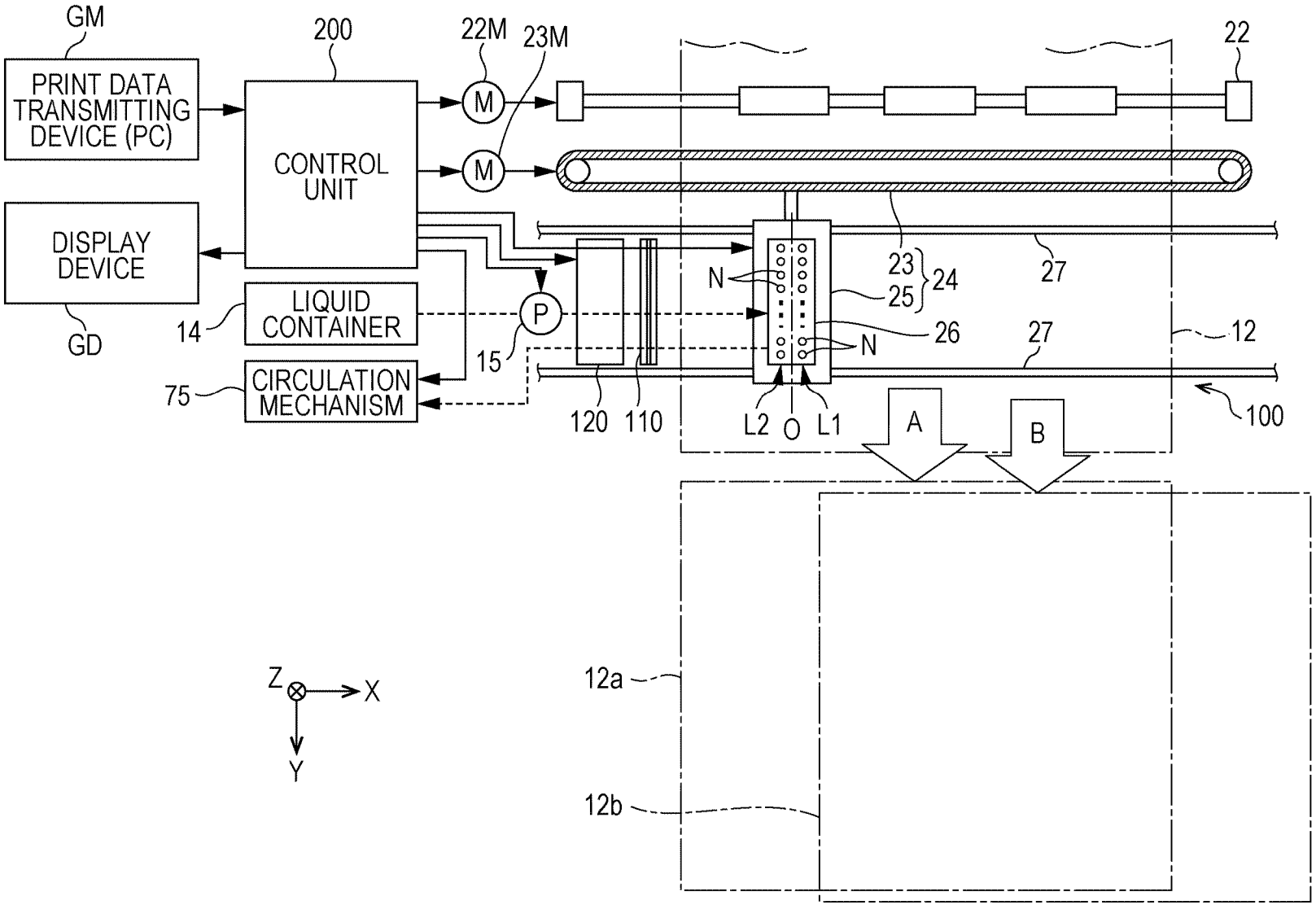
FIG. 19 is an explanatory diagram illustrating a state of discharging a medium for which printing is completed as ordinary in contrast with a state of discharging the medium in an unordinary discharge path.

FIG. 18 is a flowchart illustrating a procedure of fault occurrence notification control of the ink ejection in a liquid ejecting apparatus of a fifth embodiment. In the fault notification control, together with the completion of the printing, in order to inform the user of the fact that a fault is present in the ink ejection carried out until this point, first, the control unit 200 determines whether or not all of the printing corresponding to the print data from the print data transmitting device GM is completed (step S600). If the control unit 200 determines that the printing is not completed in step S600, the control unit 200 ends the present recovery control without performing the processes thereafter. Meanwhile, if the control unit 200 determines that the printing is completed in step S600, the control unit 200 determines whether or not the ejection fault determination number reaches the predetermined fault determination number Nm (step S610). Here, if the control unit 200 determines that the ejection fault determination number does not reach the predetermined fault determination number Nm, the control unit 200 discharges the medium 12 for which the printing is completed to the outside of the ejection region of the ink in the ordinary discharge path (step S620) and ends the fault notification control. Meanwhile, if the control unit 200 determines that the ejection fault determination number reaches the predetermined fault determination number Nm in step S610, the control unit 200 discharges the medium 12 for which the printing is completed to the outside of the ejection region of the ink in the unordinary discharge path (step S630) and ends the fault notification control. FIG. 19 is an explanatory diagram illustrating a state of discharging the medium 12 for which printing is completed as ordinary in contrast with a state of discharging the medium 12 in an unordinary discharge path.

As illustrated, the liquid ejecting apparatus 100 subjects a medium 12*a* for which the printing is completed without the ejection fault determination number reaching the predetermined fault determination number Nm to the control of the transport mechanism 22 using the control unit 200 and outputs the medium 12*a* straight along the +Y direction as illustrated by a white-filled arrow A. Meanwhile, the liquid ejecting apparatus 100 subjects a medium 12*b* for which the ejection fault determination number reaches the predetermined fault determination number Nm and the printing is completed to the control of the transport mechanism 22 using the control unit 200 and outputs the medium 12*b* obliquely along +X direction and the +Y direction as illustrated by a white-filled arrow B. The medium discharging becomes possible by providing a discharge medium receiving table closer to the bottom side of the head in the +Z direction than the liquid ejecting head 26. Specifically, the control unit 200 causes the discharge medium receiving table to move in the −X direction from an origin position at which the discharge medium receiving table receives the discharging of the medium 12*a* before the discharging of the medium 12*b*. Subsequently, after causing the medium 12*b* to be discharged onto the discharge medium receiving table which is already moved in the −X direction, the control unit 200 restores the discharge medium receiving table to the origin position. Accordingly, it is possible to discharge the medium 12*b* to a different discharge location from that of the medium 12*a*. Although the medium 12*b* overlaps the medium 12*a*, the medium 12*b* may be discharged to a different discharge location from the medium 12*a* such that the medium leading end of the medium 12*b* is positioned further in the +Y direction than that of the medium 12*a*. Accordingly, it is sufficient to change the rotational speed of the medium feed roller and set the length of the medium discharge length in the transport mechanism 22, which is convenient.

When the liquid ejecting apparatus of the fifth embodiment ends the ink ejection from the nozzle N corresponding to the print data which is the series of liquid ejection requests and completed the printing, the liquid ejecting apparatus discharges the medium 12*a* for which the printing is completed with the ejection fault determination number not reaching the predetermined fault determination number Nm and the medium 12*b* for which the printing is completed with the ejection fault determination number reaching the predetermined fault determination number Nm to different discharge locations on the outside of the ejection region of the ink. Therefore, according to the liquid ejecting apparatus of the fifth embodiment, it is possible to cause the user to more easily recognize the fact that there is a possibility of the occurrence of a reduction in the quality of the printed image which may be obtained on the medium 12 using the ink ejection from the plurality of nozzles N included in the first nozzle row L1 and the second nozzle row L2 in the liquid ejecting head 26. The medium 12*a* for which the printing is completed with the ejection fault determination number not reaching the predetermined fault determination number Nm includes the medium 12 which receives the ink ejection from the nozzles N which are determined not to have ink ejection faults in the ejection control.

F. Other Embodiments (F-1) In the third embodiment, although the fault determination span in the ejection fault determination in the ejection control is set to the detection span (the detection period) during the consecutive ink ejection timings according to the drive signals, the fault determination span is not limited to the detection span (the detection period) during the ink ejection timings as long as the fault determination span is shorter than the redetermination span in which the ejection fault is redetermined using the residual vibration transition after undergoing the application of the non-ejecting voltage in the redetermination control of the ejection fault. For example, the fault determination span may be set to the detection span (the detection period) between the m-th (where m is an integer) ejection timing and the (m+n)th (where n is an integer) ejection timing among the consecutive ink ejection timings according to the drive signals.

(F-2) In the third embodiment, although the fault determination number Nm which is a contrasting target with the ejection fault number counter Fc which represents the ejection fault determination number is set to the passage amount of the ink which passes through the pressure chambers C or the ink temperature, the configuration is not limited thereto. For example, when the non-operating time of the liquid ejecting apparatus 100 in which the supplying and collection of the ink to the pressure chambers C is not performed is increased, the ink pools in not only the pressure chambers C but also the supply paths 61, the communicating paths 63, and the like before and after the pressure chambers C and during this period, the viscosity of the ink may drop. Since the reduction in the ink viscosity is apt to bring about an ejection fault of the ink, the consecutive non-operating time of the liquid ejecting apparatus 100 is timed, the fault determination number Nm, may be set to a small value if the non-operating time is longer than a defined time. The fault determination number Nm may be set in a multi-staged manner according to the ink passage amount or the ink temperature.

(F-3) In the embodiment, although the ink which is supplied to the pressure chambers C is collected in the ink storage tank 76 by two lines of the collection tubes 78 of the ink discharge port 65*a* and the ink discharge port 65*b* of the discharge liquid chamber 65, respectively, the configuration is not limited thereto. For example, a configuration may be adopted in which only the ink discharge port 65*a* is provided in the discharge liquid chamber 65 and the ink collection is achieved from one line of the collection tube 78 which is connected to the ink discharge port 65*a*. A configuration may be adopted in which three or more collection ports are provided in the discharge liquid chamber 65 and the ink collection is achieved from multiple lines of the collection tubes 78. The connections between the liquid supplying unit and the ink inlet 49 and the ink discharge ports 65*a* and 65*b* may be reversed to reverse the flow of the ink inside the pressure chambers C.

(F-4) In the embodiment, although the plurality of nozzles N is installed on the liquid ejecting head 26 which is a print head and the liquid ejecting apparatus 100 of a head driving type which drives the liquid ejecting head 26 in the main scanning direction is adopted, a so-called line-type printer in which nozzle rows, in which the plurality of nozzles N are lined up in the main scanning direction, are lined up in the sub-scanning direction may be adopted.

(F-5) In the second embodiment, although the ink ejection (the liquid ejection) from the nozzle N which is adjacent in the main scanning direction to the nozzle N in which an ejection fault of the ink occurs is executed at a supplementary ejection droplet amount in which the ejection droplet amount is increased to supplement the amount of the ink which could not be ejected from the nozzle N having the ejection fault, the configuration is not limited thereto. Specifically, the amount of ink which could not be ejected from the nozzle N having the ejection fault may be supplemented and ejected from the nozzle N adjacent to the nozzle N having the ejection fault in the same nozzle row as the nozzle N in which the ejection fault of the ink occurs, for example, the first nozzle row L1, that is, from the nozzle N which is adjacent in the sub-scanning direction. The amount of ink which could not be ejected from the nozzle N having the ejection fault may be supplemented and ejected from the plurality of nozzles N which are adjacent to the nozzle N having the ejection fault in the main scanning direction and the sub-scanning direction. In this case, since the supplementary ejection droplet amount for each of the plurality of adjacent nozzles N is lesser, this is favorable in maintaining the quality of the printed image or the line which is obtained.

(F-6) The invention is not limited to the liquid ejecting apparatus which ejects the ink and may be applied to a predetermined liquid ejecting apparatus which ejects another liquid other than the ink. For example, it is possible to apply the invention to various liquid ejecting apparatuses such as those described below.

(1) An image recording apparatus such as a facsimile device.

(2) A color material ejecting device which is used in the manufacture of color filters for image display devices such as liquid crystal displays.

(3) An electrode material ejecting device which is used in the electrode formation of organic electro luminescence (EL) displays, field emission displays (FED), and the like.

(4) A liquid ejecting apparatus which ejects a liquid containing bio-organic matter which is used in bio-chip manufacture.

(5) A sample ejecting device which serves as a precision pipette.

(6) An ejecting device of a lubricant.

(7) An ejecting device of a resin liquid.

(8) A liquid ejecting apparatus which ejects a lubricant onto precision machinery such as clocks and cameras at pinpoint precision.

(9) A liquid ejecting apparatus which ejects a transparent resin liquid such as an ultraviolet curing resin liquid onto a substrate in order to form a hemispherical lens (an optical lens) to be used in an optical communication element or the like.

(10) A liquid ejecting apparatus which ejects an acid or an alkaline etching liquid for etching a substrate or the like.

(11) A liquid ejecting apparatus which is provided with a liquid ejecting head which ejects a minute amount of another arbitrary liquid.

The term "droplets" refers to a state of the liquid which is ejected from the liquid ejecting apparatus and includes liquids which form tails of a droplet shape, a tear shape, and a line shape. The "liquid" referred to here may be a material which the liquid ejecting apparatus is capable of ejecting. For example, the "liquid" may be a material which is in a liquid phase state, and includes high or low viscosity liquid state materials and liquid state materials such as sol, gel water, other inorganic solvents, organic solvents, solutions, liquid resins, and liquid metals (molten metals). The "liquid" not only includes liquids as a state of a material, but also includes solutions, disperses and mixtures in which particles of functional material formed from solids such as pigments and metal particulate are dissolved, dispersed or mixed into a solvent. Representative examples of the liquid include inks and liquid crystals. Here, the term "ink" includes general aqueous inks and solvent inks, as well as various liquid compositions such as gel ink and hot melt ink.

G. Other Aspects

The invention is not limited to the embodiments and modification examples, and it is possible to realize the invention with various configurations in a scope that does not depart from the gist of the invention. For example, in order to solve a portion of or all of the problems, or alternatively, in order to achieve a portion of or all of the effects, it is possible to replace or combine, as appropriate, the technical features in embodiments corresponding to technical features in each aspect described in the summary heading, the embodiments, and the modification examples. As long as a technical feature is not described as required in the specification, it is possible to remove the technical feature, as appropriate.

(1) According to an aspect of the invention, there is provided a liquid ejecting apparatus. A liquid ejecting apparatus includes a plurality of nozzles which eject a liquid, pressure chambers which communicate with the nozzles, pressure generating units which cause pressures of the pressure chambers to change, a liquid supplying unit which carries out supplying of the liquid to the pressure chambers and collection of the liquid which has passed through the pressure chambers, a controller which drives the pressure generating units of the pressure chambers corresponding to liquid ejection requests which request liquid ejection from the nozzles, and an ejection fault determination unit which determines an occurrence of a fault in the liquid ejection using a vibration transition of a residual vibration which occurs in the liquid of the pressure chambers according to a pressure change which accompanies driving of the pressure generating units, in which the controller stops the driving of the pressure generating unit of an ejection fault pressure chamber in which it is determined that a fault occurs in the liquid ejection by the ejection fault determination unit spanning at least a fixed stopping period.

Since the liquid ejecting apparatus of the aspect continues the supplying of the liquid to the plurality of pressure chambers and the collection of the liquid which passes through the pressure chambers, the circulation inside the reservoir may not be performed. The liquid ejecting apparatus of the aspect ejects the liquid from the nozzles through the pressure changes in the liquid in the pressure chambers caused by the pressure generating units in each of the pressure chambers in a situation in which the supplying and the collection of the liquid to the plurality of pressure chambers is continued. Upon ejecting the liquid, when it is determined that a fault occurs in the liquid ejection in the situation of ejecting the liquid, the liquid ejecting apparatus of the aspect stops the liquid ejection from the nozzle of the ejection fault pressure chamber spanning a fixed stopping period. Since the supplying and the collection of the liquid to the plurality of pressure chambers are continued even in the stopping period, the bubbles or foreign matter which enter the pressure chambers may be taken away in the liquid which passes through the pressure chambers in the stopping period. Accordingly, it is possible that the ejection fault will disappear after the passage of the stopping period. Accordingly, according to the liquid ejecting apparatus of the aspect, in addition to being capable of handling the bubbles and foreign matter even if inter-reservoir circulation is not performed, it is possible to perform the removal of the bubbles and foreign matter and the erasure of the bubbles from the control-target nozzle even during the ink ejection of the nozzles other than the control-target nozzle. Additionally, the liquid ejection stopping target is the nozzle of the ejection fault pressure chamber, and in the nozzles of the other pressure chambers, the liquid ejection is continued even in the stopping period due to the driving of the pressure generating units corresponding to the liquid ejection requests. Accordingly, according to the liquid ejecting apparatus of the aspect, since it is not necessary to stop all of the liquid ejection from the plurality of nozzles, the availability factor is increased.

(2) The liquid ejecting apparatus of the aspect may further include a print head which includes a nozzle row including the plurality of nozzles and on which the pressure chambers and the pressure generating units are installed, and a head movement mechanism which causes the print head to scan with respect to an ejection target of the liquid, in which the controller may drive the pressure generating units while controlling the head movement mechanism to cause the print head to scan. Accordingly, since the printing is performed while causing the print head to scan and since the bubbles and foreign matter move due to the acceleration during the scanning, it is possible to expect the recovery of the ejection fault nozzle to happen sooner.

(3) In the liquid ejecting apparatus of the aspect, in the stopping period, the controller may execute liquid ejection from a nozzle of an adjacent pressure chamber which is adjacent to the ejection fault pressure chamber using a supplementary ejection droplet amount in which an ejection droplet amount is increased to supplement the liquid ejection which is requested of the ejection fault pressure chamber. Accordingly, it is possible to suppress a reduction in quality of the ejected product which is obtained on the ejection target through the liquid ejection from the plurality of nozzles even without stopping the printing.

(4) In the liquid ejecting apparatus of the aspect, the print head may be provided with at least two of the nozzle rows lined up in a scanning direction, and the controller may execute the liquid ejection from the nozzle of the adjacent pressure chamber which is adjacent to the ejection fault pressure chamber in the scanning direction using the supplementary ejection droplet amount. Accordingly, it is possible to suppress a reduction in quality of the ejected product without stopping the printing by performing the liquid ejection using a supplementary ejection droplet amount from the nozzle which is adjacent to the ejection fault nozzle in the direction of scanning.

(5) In the liquid ejecting apparatus of the aspect, in the stopping period of the ejection fault pressure chamber, the controller may drive the pressure generating unit of the ejection fault pressure chamber such that a pressure change which does not cause liquid ejection from the nozzle of the ejection fault pressure chamber occurs in the ejection fault pressure chamber, in the stopping period, the ejection fault determination unit may repeat a redetermination of occurrence of a fault in the liquid ejection using a vibration transition of a residual vibration of the liquid according to a pressure change which accompanies the driving of the pressure generating unit of the ejection fault pressure chamber for the ejection fault pressure chamber, and when the ejection fault determination unit determines that there is no fault in the liquid ejection from the nozzle of the ejection fault pressure chamber in the redetermination, the controller may restart the driving of the pressure generating unit of the ejection fault pressure chamber regardless of passage of the fixed period. Accordingly, it is possible to restart the liquid ejection from the nozzle of the pressure chamber in which the ejection fault occurs at an early stage.

(6) In the liquid ejecting apparatus of the aspect, the ejection fault determination unit may repeatedly execute the redetermination which is performed for the ejection fault pressure chamber in the stopping period over a longer period than a detection period in which the vibration transition is detected in the determination from before performing the redetermination. By adopting this configuration, the following merits are obtained. Although the pressure change during the redetermination does not cause the liquid ejection from the nozzle, the pressure change may influence the flow of the liquid which passes through the ejection fault pressure chamber. However, by rendering the period of the redetermination a longer period than the detection period before performing the redetermination, it is possible to reduce the influence of the pressure change during the redetermination on the flow of the liquid which passes through the ejection fault pressure chamber. Accordingly, it is possible to ensure that the taking out of the bubbles and foreign matter by the liquid which passes through the ejection fault pressure chamber is not impeded and to recover from the ejection fault in the ejection fault nozzle at an early stage.

(7) The liquid ejecting apparatus of the aspect may further include a recovery unit which brings about a recovery from ejection faults which occur in the liquid ejection from the nozzles, in which when the ejection fault determination unit determines that there is a fault in the liquid ejection from the nozzle of the ejection fault pressure chamber in the redetermination which is performed for the ejection fault pressure chamber consecutively spanning a predetermined fault determination number, the controller may drive the recovery unit to achieve a recovery from a liquid ejection fault from the nozzle of the ejection fault pressure chamber. Accordingly, it is possible to reliably restart the liquid ejection from the nozzle of the pressure chamber in which the ejection fault occurs.

(8) In the liquid ejecting apparatus of the aspect, the controller may set the fault determination number to a lower number the greater a passage amount of liquid which passes through the ejection fault pressure chamber, or alternatively, the lower a temperature of the liquid. By adopting this configuration, the following merits are obtained. The greater the passage amount of the liquid which passes through the ejection fault pressure chamber, the higher the chance that the bubbles or foreign matter which enters the ejection fault pressure chamber will be taken away by the liquid which passes through the ejection fault pressure chamber. Since the lower the temperature of the liquid which passes through the ejection fault pressure chamber, the more the bubbles dissolve into the liquid, the higher the chance that the bubbles which enter the ejection fault pressure chamber will be taken away by the liquid which passes through the ejection fault pressure chamber. Accordingly, even if the number of times the fault determination occurs is few, it is possible to secure the reliability of the taking out of the bubbles or foreign matter by the liquid which passes through the ejection fault pressure chamber.

(9) In the liquid ejecting apparatus of the aspect, when the driving of the pressure generating unit for the ejection fault pressure chamber is stopped, the controller may perform a fault notification of a fact that a fault occurs in the liquid ejection. Accordingly, it is possible to cause the user of the liquid ejecting apparatus to recognize the fact that there is a possibility of the occurrence of a reduction in the quality of the ejection product which may be obtained on the ejection target of the liquid ejection from the plurality of nozzles.

(10) In the liquid ejecting apparatus of the aspect, the controller may perform marking of the fault notification through ejection of the liquid onto an ejection target by performing the liquid ejection from the nozzles on the ejection target of the liquid. Accordingly, it is possible to cause the user of the liquid ejecting apparatus to easily recognize the fact that there is a possibility of the occurrence of a reduction in the quality of the ejection product which may be obtained on the ejection target of the liquid ejection from the plurality of nozzles.

(11) The liquid ejecting apparatus may further include a discharging mechanism which, when the liquid ejection from the nozzles corresponding to the liquid ejection request onto an ejection target of the liquid is completed, discharges the ejection target to a discharge location outside of an ejection region of the liquid from the nozzles, in which the controller may control the discharging mechanism to discharge the ejection target which receives the liquid ejection from the nozzle of the ejection fault pressure chamber to a different discharge location from that of the ejection target for which it is not determined that there is a fault in the liquid ejection by the ejection fault determination unit. Accordingly, it is possible to cause the user of the liquid ejecting apparatus to more easily recognize the fact that there is a possibility of the occurrence of a reduction in the quality of the ejection product which may be obtained on the ejection target of the liquid ejection from the plurality of nozzles.

It is possible to realize the invention with various aspects, for example, it is possible to realize the invention with an aspect of a liquid ejection method or the like.

The present application is based on, and claims priority from JP Application Serial Number 2018-56661, filed Mar. 23, 2018, the disclosure of which is hereby incorporated by reference herein in its entirety.

What is claimed is:

1. A liquid ejecting apparatus comprising:

a plurality of nozzles which eject a liquid;

pressure chambers which communicate with the nozzles;

pressure generating units which cause pressures of the pressure chambers to change;

a liquid supplying unit which carries out supplying of the liquid to the pressure chambers and collection of the liquid which has passed through the pressure chambers;

a controller which drives the pressure generating units of the pressure chambers corresponding to liquid ejection requests which request liquid ejection from the nozzles; and an ejection fault determination unit which determines an occurrence of a fault in the liquid ejection using a vibration transition of a residual vibration which occurs in the liquid of the pressure chambers according to a pressure change which accompanies driving of the pressure generating units, wherein the controller stops the driving of the pressure generating unit of an ejection fault pressure chamber in which it is determined that a fault occurs in the liquid ejection by the ejection fault determination unit spanning at least a fixed stopping period, wherein the liquid supplying unit continues both the supplying of the liquid to the pressure chamber and the collection of the liquid which has passed through the pressure chambers during the stopping period.

2. The liquid ejecting apparatus according to claim 1, further comprising:

a print head which includes a nozzle row including the plurality of nozzles and on which the pressure chambers and the pressure generating units are installed; and a head movement mechanism which causes the print head to scan with respect to an ejection target of the liquid, wherein the controller drives the pressure generating units while controlling the head movement mechanism to cause the print head to scan.

3. The liquid ejecting apparatus according to claim 2, wherein, in the stopping period, the controller executes liquid ejection from a nozzle of an adjacent pressure chamber which is adjacent to the ejection fault pressure chamber using a supplementary ejection droplet amount in which an ejection droplet amount is increased to supplement the liquid ejection which is requested of the ejection fault pressure chamber.

4. The liquid ejecting apparatus according to claim 3, wherein the print head is provided with at least two of the nozzle rows lined up in a scanning direction, and wherein the controller executes the liquid ejection from the nozzle of the adjacent pressure chamber which is adjacent to the ejection fault pressure chamber in the scanning direction using the supplementary ejection droplet amount.

5. The liquid ejecting apparatus according to claim 1, wherein, in the stopping period of the ejection fault pressure chamber, the controller drives the pressure generating unit of the ejection fault pressure chamber such that a pressure change which does not cause liquid ejection from the nozzle of the ejection fault pressure chamber occurs in the ejection fault pressure chamber, wherein, in the stopping period, the ejection fault determination unit repeats a redetermination of occurrence of a fault in the liquid ejection using a vibration transition of a residual vibration of the liquid according to a pressure change which accompanies the driving of the pressure generating unit of the ejection fault pressure chamber for the ejection fault pressure chamber, and wherein when the ejection fault determination unit determines that there is no fault in the liquid ejection from the nozzle of the ejection fault pressure chamber in the redetermination, the controller restarts the driving of the pressure generating unit of the ejection fault pressure chamber regardless of passage of the fixed period.

6. The liquid ejecting apparatus according to claim 5, wherein the ejection fault determination unit repeatedly executes the redetermination which is performed for the ejection fault pressure chamber in the stopping period over a longer period than a detection period in which the vibration transition is detected in the determination from before performing the redetermination.

7. The liquid ejecting apparatus according to claim 5, further comprising:

a recovery unit which brings about a recovery from ejection faults which occur in the liquid ejection from the nozzles, wherein when the ejection fault determination unit determines that there is a fault in the liquid ejection from the nozzle of the ejection fault pressure chamber in the redetermination which is performed for the ejection fault pressure chamber consecutively spanning a predetermined fault determination number, the controller drives the recovery unit to achieve a recovery from a liquid ejection fault from the nozzle of the ejection fault pressure chamber.

8. The liquid ejecting apparatus according to claim 7, wherein the controller sets the fault determination number to a lower number the greater a passage amount of liquid which passes through the ejection fault pressure chamber, or alternatively, the lower a temperature of the liquid.

9. The liquid ejecting apparatus according to claim 1, wherein, after the driving of the pressure generating unit for the ejection fault pressure chamber is stopped, then the controller performs a fault notification of a fact that a fault occurs in the liquid ejection.

10. The liquid ejecting apparatus according to claim 9, wherein the controller performs marking of the fault notification through ejection of the liquid onto an ejection target by performing the liquid ejection from the nozzles on the ejection target of the liquid.

11. The liquid ejecting apparatus according to claim 1, further comprising:

a discharging mechanism which, when the liquid ejection from the nozzles corresponding to the liquid ejection request onto an ejection target of the liquid is completed, discharges the ejection target to a discharge location outside of an ejection region of the liquid from the nozzles, wherein the controller controls the discharging mechanism to discharge the ejection target which receives the liquid ejection from the nozzle of the ejection fault pressure chamber to a different discharge location from that of the ejection target for which it is not determined that there is a fault in the liquid ejection by the ejection fault determination unit.

12. The liquid ejecting apparatus according to claim 1, wherein, after the stopping period has passed, the controller resumes the driving of the pressure chamber.

13. The liquid ejecting apparatus according to claim 1, wherein the liquid supplying unit continues both the supplying of the liquid to the pressure chamber and the collection of the liquid which has passed through the pressure chambers during the stopping period such that foreign material in the ejection fault pressure chamber is at least partially removed.

14. The liquid ejecting apparatus according to claim 1, wherein an ejection fault determination unit determines non-ejection of ink as the occurrence of the fault in the liquid ejection.

15. The liquid ejecting apparatus according to claim 1, wherein the stopping period is from 1 to 30 seconds.

* * * * *